US012533563B2

(12) United States Patent
Yoabov

(10) Patent No.: US 12,533,563 B2
(45) Date of Patent: Jan. 27, 2026

(54) PUNCH BACK PUNCHING BAG WITH ARMS

(71) Applicant: Alexander Yoabov, Ashdod (IL)

(72) Inventor: Alexander Yoabov, Ashdod (IL)

( * ) Notice: Subject to any disclaimer, the term of this patent is extended or adjusted under 35 U.S.C. 154(b) by 140 days.

(21) Appl. No.: 18/564,106

(22) PCT Filed: Oct. 24, 2023

(86) PCT No.: PCT/IL2023/051095

§ 371 (c)(1),
(2) Date: Nov. 27, 2023

(87) PCT Pub. No.: WO2024/095256

PCT Pub. Date: May 10, 2024

(65) Prior Publication Data

US 2025/0073555 A1 Mar. 6, 2025

Related U.S. Application Data

(60) Provisional application No. 63/422,027, filed on Nov. 3, 2022.

(51) Int. Cl.

| | |
|---|---|
| ***A63B 69/24*** | (2006.01) |
| ***A63B 69/20*** | (2006.01) |
| ***A63B 69/22*** | (2006.01) |
| ***A63B 69/28*** | (2006.01) |
| ***A63B 69/32*** | (2006.01) |

(52) U.S. Cl.

CPC ..... *A63B 69/244* (2022.08); *A63B 69/22* (2022.08); *A63B 69/222* (2022.08); *A63B 69/24* (2013.01); *A63B 69/28* (2022.08); *A63B 69/32* (2013.01); *A63B 69/305* (2022.08); *A63B 69/322* (2022.08); *A63B 2214/00* (2020.08); *A63B 2220/833* (2013.01); *A63B 2225/74* (2020.08); *A63B 2244/102* (2013.01)

(58) Field of Classification Search

CPC ..... A63B 69/22; A63B 69/222; A63B 69/24; A63B 69/244; A63B 69/28; A63B 69/305; A63B 69/32; A63B 69/322; A63B 2214/00; A63B 2220/833; A63B 2225/74; A63B 2244/102

See application file for complete search history.

(56) References Cited

U.S. PATENT DOCUMENTS

| | | | | |
|---|---|---|---|---|
| 6,302,831 | B1 * | 10/2001 | Henry | A63B 69/305 482/90 |
| 7,416,517 | B2 | 8/2008 | Mitchell | |
| 7,488,276 | B2 | 2/2009 | Luigi | |
| 7,862,485 | B2 * | 1/2011 | Luigi | A63B 69/30 482/89 |
| 8,777,818 | B1 * | 7/2014 | Tate, Jr. | A63B 69/215 482/83 |

(Continued)

FOREIGN PATENT DOCUMENTS

| | | | | |
|---|---|---|---|---|
| CN | 105392536 A | * | 3/2016 | A63B 69/305 |
| CN | 112973082 B | | 3/2022 | |

(Continued)

*Primary Examiner* — Megan Anderson

(57) ABSTRACT

The present invention relates to motorized boxing bag, and, more particularly, but not exclusively, with arms for use in fighting training, aerobic training, strength training, reflex training, game play, or any combination thereof.

14 Claims, 25 Drawing Sheets

(56) References Cited

U.S. PATENT DOCUMENTS

| | | | | |
|---|---|---|---|---|
| 9,504,893 | B2 | 11/2016 | Nelson | |
| 9,744,420 | B1 | 8/2017 | Bergamini | |
| 11,311,787 | B2 * | 4/2022 | Kawar | A63B 24/0075 |
| 12,076,629 | B2 * | 9/2024 | Lupan | A63B 24/0087 |
| 2004/0248633 | A1 * | 12/2004 | Trawick | A63B 69/215 463/8 |
| 2015/0065312 | A1 | 3/2015 | Harrigan | |
| 2015/0273307 | A1 | 10/2015 | Karimi | |

FOREIGN PATENT DOCUMENTS

| | | | | |
|---|---|---|---|---|
| CN | 113769353 | B | 12/2022 | |
| DE | 102014110090 | A1 * | 1/2016 | A63B 69/222 |
| GB | 2458688 | A * | 9/2009 | A63B 69/305 |
| IE | 20200162 | A1 * | 2/2022 | |

* cited by examiner

PUNCH BACK PUNCHING BAG WITH ARMS

RELATED APPLICATIONS

This application is a Continuation in Part of International Application PCT/IL2023/051095 filed 24 Oct. 2023 which claims the benefit of priority under 35 USC § 119(e) of U.S. Provisional Patent Application No. 63/422,027 filed 3 Nov. 2022.

This application claims benefit of priority of International Application PCT/IL2023/051095 filed 24 Oct. 2023 and U.S. Provisional Patent Application No. 63/422,027 filed 3 Nov. 2022.

The contents of the above applications are all incorporated by reference as if fully set forth herein in their entirety.

FIELD AND BACKGROUND OF THE INVENTION

The present invention, in some embodiments thereof, relates to motorized boxing bag, and, more particularly, but not exclusively, with arms.

Boxing bags or punching bags are commonly used in the training of boxers, Mixed martial arts (MMA) fighters, martial artists, combat sports practitioners and are even used in sword and other hand weapons training. The punching bag may include a large, cylindrical bag, which may be suspended from the ceiling and/or attached to the floor and/or be freestanding. The punching bag is generally used to improve technique, provide strength training for power, build better balance and coordination, and even to reduce stress. Many martial artists train with a wooden dummy, such as a "Wing Chun" wooden dummy which has an arm and leg configuration designed to cultivate fighting skill. However, traditional boxing bags and wooden dummies generally do not hit back and are limited in the ability to train a fighter's reflexes or integration of blocking and striking techniques in response to a moving target.

Some inventors have suggested a punching bag with movable mechanical arms. The actuator that moves the mechanical arms may be directly connected to the punching bag. Such a configuration may add weight and complexity. This may limit the size and power of the actuator used and/or the power of the punches aimed at the user. The placement of mechanical parts on the bag may make those parts vulnerable to damage from shock. Repeated shocks (e.g., punches) to the bag over time may damage the actuator, and a poorly aimed punch might hit the actuator damaging the mechanism and/or the user.

Therefore, there is a need for a robust punching bag with arms, which may be used to improve technique, provide strength training for power, build better balance and coordination, while training a fighter's reflexes, and integrating blocking and striking techniques in response to a moving target.

SUMMARY OF THE INVENTION

According to an aspect of some embodiments of the invention, there is provided a system for sparring with a first punching bag including: a bearing connected to rotatably support at least part of a weight of the first punching bag; a motor configured for rotating the first punching bag, and an arm mounted on and protruding from a side of the first punching bag.

According to some embodiments of the invention, the system further includes: a shock absorber interconnecting between the first punching bag and the motor.

According to some embodiments of the invention, the bearing is connected between the motor and the first punching bag and the motor rotates the bearing.

According to some embodiments of the invention, the bearing is connected to a ceiling.

According to some embodiments of the invention, the bearing is connected to a floor.

According to some embodiments of the invention, the bearing is connected to a stand supported on a floor.

According to some embodiments of the invention, the first punching bag is connected to the bearing by a tension element.

According to some embodiments of the invention, the motor is not weight bearing.

According to some embodiments of the invention, the motor is connected to a processor controlled by a user interface.

According to some embodiments of the invention, the motor is connected to a processor programmable for a preset set of actions.

According to some embodiments of the invention, the motor is connected to a processor controlled remotely.

According to some embodiments of the invention, the shock absorber is configured to absorb rotational and/or translational shock from a blow.

According to some embodiments of the invention, the shock absorber includes a tension element.

According to some embodiments of the invention, the arm is adjustably mounted on the first punching bag.

According to some embodiments of the invention, the arm is reversibly mounted on the first punching bag.

According to some embodiments of the invention, the arm is attached to the first punching bag with a belt.

According to some embodiments of the invention, the arm and the first punching bag contain no rigid parts.

According to some embodiments of the invention, the first punching bag is connected to a second punching bag.

According to some embodiments of the invention, the second punching bag includes a second arm protruding from a side thereof.

According to some embodiments of the invention, the first punching bag is suspended from the bearing and wherein the second punching bag is connected to a second bearing from below.

According to some embodiments of the invention, a bottom of the second punching bag is connected to the second bearing.

According to some embodiments of the invention, the second bearing is connected to or supported on a floor.

According to some embodiments of the invention, the second punching bag rotates independently of the first punching bag.

According to some embodiments of the invention, the second punching bag is attached to a second motor that drives rotation of the second bag.

According to some embodiments of the invention, at least one of the first punching bag includes a target marker.

According to some embodiments of the invention, the target marker includes a LED light.

According to some embodiments of the invention, the first punching bag includes a sensor.

According to some embodiments of the invention, the target marker includes a sensor configured to detect a blow.

According to some embodiments of the invention, the sensor is configured to detect a blow, position of a blow, strength of the blow, angle of the blow, speed of the blow or any combination thereof.

According to some embodiments of the invention, the user interface is configured to facilitate selection of at least one user defined parameter.

According to some embodiments of the invention, the at least one user defined parameter is a fighting style, level, speed, power, weight, age, height, or any combination thereof.

According to some embodiments of the invention, the system is configured for use in fighting training, aerobic training, strength training, reflex training, game play, or any combination thereof.

According to an aspect of some embodiments of the invention, there is provided a method for sparring with a punch back punching bag, the method including: supplying a first punching bag with a padded arm protruding from a side thereof; supporting at least part of a weight of the first punching bag on a bearing; rotating the first punching bag with a motor wherein the motor does not support the entire weight of the first punching bag; and giving a blow with the arm to a sparring user as a result of the rotating.

According to some embodiments of the invention, the supporting includes suspending the first punching bag on the bearing.

According to some embodiments of the invention, the rotating is of the bearing.

According to some embodiments of the invention, the method further includes absorbing shock between the first punching bag and the motor with a shock absorber.

According to some embodiments of the invention, the method further includes supplying a second punching bag with a second arm.

According to some embodiments of the invention, the method further includes connecting the second punching bag to the first punching bag by a twistable connector.

According to some embodiments of the invention, the twistable connector includes a chain, a strap, or a swivel bearing.

According to some embodiments of the invention, the method further includes rotating the second bag independent of the first bag with a second motor, wherein the second motor does not support the entire weight of the second bag.

According to some embodiments of the invention, the method further includes giving a blow with the second arm to a sparring user as a result of the rotating.

According to some embodiments of the invention, the method further includes detecting a blow to at least one of the first punching bag and the second punching bag by a sensor.

According to some embodiments of the invention, the detecting is of a blow, position of a blow, strength of the blow, angle of the blow, speed of the blow, or any combination thereof.

According to some embodiments of the invention, the method further includes facilitating selection of at least one user defined parameter through a user interface, wherein the at least one user defined parameter is a fighting style, level, speed, weight, age, height, or any combination thereof.

According to an aspect of some embodiments of the invention, there is provided a method for a sparring game with a punch back punching bag, the method including: supplying a punching bag with an arm protruding therefrom; giving a blow with the arm to a sparring user; and providing audio and/or visual feedback to the user by a user interface.

According to some embodiments of the invention, the at least one user defined parameter is a fighting style, level, speed, weight, age, height, or any combination thereof.

According to some embodiments of the invention, the method further includes programing the processor for a preset set of actions.

According to some embodiments of the invention, the method further includes detecting a blow to the punching bag by a sensor.

According to some embodiments of the invention, the detecting is of a blow, position of a blow, strength of the blow, angle of the blow, speed of the blow, a health of the punching bag, a score of the user, a score of an opponent or any combination thereof.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced. In the figures:

FIG. 2.

DESCRIPTION OF THE INVENTION

Figure 1:
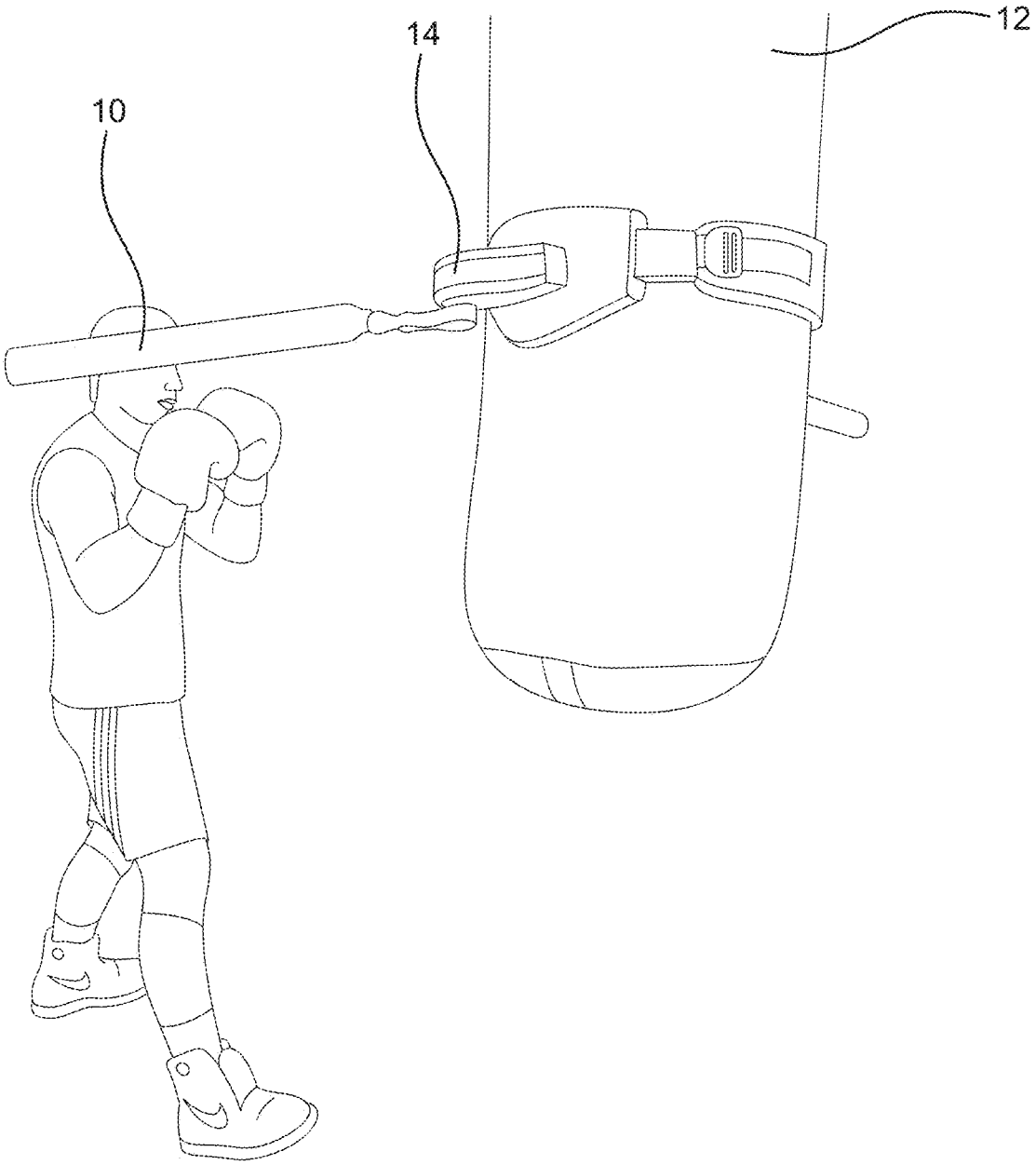
FIG. 1 Prior art
FIG. 1: Exemplary photograph of a prior art punching bag with mechanical arms.

The present invention, in some embodiments thereof, relates to punch back punching bag, and, more particularly, but not exclusively, with arms.

Overview

An aspect of some embodiments of the current invention relates to a punch back punching bag is disclosed and described. Advantageously, the punch back punching bag may be used to train a user's reflexes, and/or allow integration of blocking and striking techniques. Additionally, the punch back punching bag may be sufficiently robust to withstand repeated heavy blows, such that the user does not need to pull their punches and/or worry that their blows may damage the arms and/or delicate arm mechanism.

Some embodiments relate to a punching bag which trains a fighter's reflexes, allows integration of blocking and striking techniques, and is sufficiently robust to withstand repeated heavy blows. For example, embodiments of the invention may be used for training and/or sparring (e.g., in boxing, kick boxing, MMA, karate, muay Thai, etc.). For example, a user may aim blows at the bag while defending against blows from the bag.

According to some embodiments, the punch back punching bag may include a punching bag, an axel which may rotate the punching bag, a motor which may rotate the axel and one or more attachable arms.

According to some embodiments, the punching bag may consist of a single bag. According to some embodiments, the punching bag may consist of two or more connected punching bags. Optionally, single bag and/or the two or more connected punching bags may include a heavy bag (e.g., weighing between 25 to 40 kg and/or between 40 to 150 kg and/or between 150 to 300 kg) and/or a lighter weight bag (e.g., weighing between 1 to 5 kg and/or between 5 to 30 kg and/or between 30 to 60 kg) (e.g., a double-end bag). Optionally, the two or more connected punching bags may be rotated together and/or individually. Optionally, a first bag may be rotated by an upper axel connected to the top of the first bag. Optionally, a second bag may be rotated by an upper or lower axel connected to the top or bottom of the second bag. Optionally, the punching bag may be attached to one or more axels, e.g., at the top and/or bottom and/or between two punching bags.

Various sorts of punching bags may be included in the current invention. The different bags may be used alone and/or in combination. For example, a heavy bag may be used for developing power, strength, and endurance. For example, a light bag may be used to improve speed and endurance. For example, a speed bag may be used to improve speed, timing and accuracy.

In some embodiments, a heavy bag of the current invention may be used to improve hand-eye coordination, timing, and/or speed. Optionally the bag may be cylindrical in shape. Optionally, the punching bag may weigh between 40 and 150 kg. The punching bag may be hung from the ceiling or a stand and/or supported from below. The bag may optionally be used to practice all types of punches and kicks.

In some embodiments, the current invention may include one or more double-end bags. For example, the punching bag may weigh between 8 to 30 kg. Optionally, the double-end bag may be suspended from the ceiling and/or a stand. In some embodiments, the bag may include a ball on one or both ends. Double-end bags are typically used to improve hand-eye coordination, timing, and/or speed. Additionally, or alternatively, a double bag may be used for developing power, strength, and endurance.

In some embodiments, the current invention may include one or more speed bags. For example, a speed bag may weigh between 0.5 and 5 kg. The speed bag may be attached to a speed bag platform. Optionally, the speed bag may be rotated. In some embodiments, the bag may be used to improve hand-eye coordination, speed, and rhythm.

In some embodiments, the invention may include a reflex bag. For example, the reflex bag may weigh between 0.2 and 1 kg. The reflex bag is optionally attached to a reflex bag platform. For example, the bag may be used to improve hand-eye coordination, reflexes, and/or reaction time.

In some embodiments, the current invention may include one or more teardrop bags. For example, the bag may be shaped like a teardrop. Optionally, the teardrop bag is used for developing power and/or accuracy. Optionally, the bag may weigh between 40 to 150 kg. The bag is optionally hung from the ceiling and/or a stand. Teardrop bags may be good for practicing uppercuts and hooks.

In some embodiments, the current invention may include one or more wrecking ball bags. For example, the wrecking ball bag may be similar to teardrop bag and/or rounder and/or heavier. The wrecking ball bag may be hung from the ceiling and/or a stand. Optionally the wrecking ball bag may be used for developing power and/or explosiveness. Additionally, or alternatively, the wrecking ball bags may be used for practicing uppercuts and/or hooks.

In some embodiments, the current invention may include one or more aqua bags. For example, the bag may be filled with water and/or another fluid and/or gel. Optionally the bag may stand on the ground and/or be hung from above (e.g., from a stand and/or a ceiling). The bag may, weigh for example, between 20 and 100 kg. Optionally the aqua bag may be used for developing power and/or endurance. Aqua bags may be used for practicing all types of punches and kicks.

In some embodiments, the current invention may include one or more free-standing punching bags. The punching bag may be filled a fluid (e.g., water) and/or a particulate (e.g., sand and/or foam balls) and/or a gel and/or a gas (e.g., air). Optionally, the punching bag may stand on the ground and/or on a rotating base and/or be hung from above (e.g., from a stand and/or a ceiling). The punching bag may weigh between 40 and 100 kg. Optionally, the punching bag may be used for developing power and/or endurance. Free-standing punching bags may typically be used for practicing all types of punches and kicks.

According to some embodiments, the punch back punching bag may be various lengths and/or widths, e.g., a standard boxing bag, MMA bag, etc. Optionally, the punch back punching bag may be range between about 10 cm to about 50 cm, and/or between about 50 cm to about 1 m in length, and/or between about 1 m to about 1.5 m in length and/or between about 1.5 to about 2 min length and/or between about 2 to about 3 m in length. Optionally, the width of the punch back punching bag may range between about 10 to about 30 cm and/or between about 30 to about 45 cm and/or between about 45 to about 60 cm and/or between about 60 to about 75 cm and/or between about 75 to about 150 cm.

According to some embodiments, the punching bag may be attached to the ceiling and/or the floor and/or a bracket and/or be free standing. Optionally, the punching bag may be portable. Optionally, the punching bag may be simple to install e.g., at home, in a gym, dojo, arcade, etc.

According to some embodiments, the punching bag may include a core. Optionally, the core may include sand, wood, cotton batting, one or more weights, and/or may be a hollow core which may optionally be filled with water, any other suitable material (e.g., a fluid and/or a particulate (e.g., sand and/or foam balls) and/or a gel and/or a gas (e.g., air)). and/or a combination thereof. Optionally, the punching bag may have various weights. Optionally, the weight of the punching bag may be adjustable. Optionally, the weight of the punching bag may range between about 2 Kg to about 10 Kg, between about 10 Kg to about 20 Kg, between about 20 Kg to about 50 Kg, between about 50 Kg to about 100 Kg, between about 100 Kg to about 150 Kg, between about 150 Kg to about 200 Kg, between about 200 Kg to about 300 Kg, or between about 300 Kg to about 500 Kg. For example, the punching bag may be a single long heavy bag to which one or more sets of arms may be attached. For example, the punching bag may include two lighter and smaller punching bags to which one or more sets of arms may be attached.

According to some embodiments, for a single punching bag the elastic element and/or the motor may be connected at the top and/or on the bottom of the punching bag. Optionally, the elastic element and/or clutch may be between bag and the motor. Optionally, this may protect the motor from the shock caused by hitting the bag.

According to some embodiments, two or more connected punching bags may be connected with a swivel and/or bearing between them. Optionally, each punching bag may have a separate motor. Optionally, the elastic element and/or clutch may be between bag and the motor. Optionally, this may protect the motor from the shock caused by hitting the bag. Optionally, the two or more connected punching bags may be easy to install, and/or transport. Optionally, the two or more connected punching bags may rotate faster and/or more unpredictably than a single heavy bag.

According to some embodiments, one or more arms may be connected to a punching bag. Optionally, one or more pairs of arms may be attached to a punching bag. Optionally, the one or more arms may be reversibly attached to a punching bag. Optionally, the position and/or angle of one or more arms attached to a punching bag may be adjusted, e.g., in response to the height and/or reach of the user, and/or to mimic the anticipated height of a user's opponent, to simulate blows from arms, and/or legs, etc. Optionally, the one or more arms may be attached to the punching bag at the height of an opponents' arms, elbows, knees, feet, etc. Optionally, an arm may be attached to a punching bag on one side of the punching bag within the top portion of the bag, and a second arm may be attached to the punching bag on another side of the punching bag either at the same height as the first arm or at a different height to the first arm, such as in the lower portion of the punching bag. Optionally, the punching bag may be rotatable in one or both directions. Optionally, the punching bag may be rotated through an arc of 45°, and/or an arc of 60°, and/or an arc of 90°, and/or an arc of 120°, and/or an arc of 180°, and/or an arc of 270°, and/or an arc of 360°. Optionally, multiple arms may protrude parallel to each other on the same or opposites sides of the bag. Alternatively or additionally, multiple arms may protrude at different angles to each other (e.g., between 0 to 45 degrees and/or between 45 to 90 degrees, and/or between 60 to 120 degrees and/or between 90 to 135 degrees and/or between 135 to 180 degrees and/or between 150 to 210 degrees.

For example, when the punching bag rotates in one direction a blow to head is simulated and then when rotated in the opposite direction a blow to the body is simulated. For example, the punching bag may rotate 180° and/or then simulate blows from opposite sides to the head and body.

According to some embodiments, the one or more arms may be reversibly attached to a punching bag by one or more fasteners. Optionally, the one or more fasteners may be adjustable. Optionally, the one or more fasteners may be lockable. Optionally, the one or more fasteners may include clips. Alternatively, and/or additionally, an arm may be attached to a strap and/or belt and/or jacket that wraps around the punching bag. For example, the strap may be wrapped around the bag and/or tied to the bag and/or clasped to the bag. Optionally, the arms may be moved up or down along the length of the punching bag. Optionally, the arms may be switched, e.g., for smaller arms to fit a child, such as face closer to body, arms shorter, etc.

In some embodiments an arm may protrude horizontally. Alternatively, or additionally, an arm may have an elbow (for example, the elbow may be bent downward and/or upward and/or forward and/or backward and/or straight). Optionally, the elbow my bend more easily than a portion of the arm adjacent to the elbow. Alternatively, the arm may be curved. Alternatively, or additionally, the arm may be slanted downward and/or upward and/or forward and/or backward. For example, the distal end of the arm may rest at a position between 10 to 20 cm below the proximal end and/or between 20 to 40 cm above the proximal end. For example, the distal end of the arm may rest at a position between 10 to 20 cm above the proximal end and/or between 20 to 40 cm below the proximal end. In some embodiments, the arm may be cylindrical in shape. Alternatively, or additionally, the arm may include a knob and/or a swelling. For example, the swelling may be between 1.1 to 1.5 times the width of an adjacent portion of the arm and/or the swelling may be between 1.5 to 2.5 times the width of an adjacent portion of the arm and/or the swelling may be between 2.5 to 5 times the width of an adjacent portion of the arm. For example, a knob may be locked at or near and/or a distal end of the arm (e.g., within the distal ⅛ and/or distal ¼ and/or distal ½ of the arm). Optionally, a middle portion of the arm may have a diameter and/or thickness of between 1 to 3 cm, and/or between 3 to 10 cm, and/or between 10 to 20 cm, and/or between 20 to 40 cm. Optionally, a distal portion of the arm may have a diameter and/or thickness of between 1 to 3 cm, and/or between 3 to 10 cm, and/ow between 10 to 20 cm, and/or between 20 to 40 cm.

According to some embodiments, the arms may include an actuator. According to some embodiments, the arms may not include an actuator. Optionally, the size and/or length and/or amount of padding of the arms may be adjusted, e.g., depending on the height, experience, weight and/or reach of the user. Optionally, the one or more arms may be attached to the punching bag to simulate the blows of an opponent, e.g., at the height experience, weight and/or reach of an anticipated opponent, etc. Optionally, the one or more arms may be attached to the punching bag to simulate blows from an opponent's fists, elbows, thighs, knees and/or feet, and/or a combination thereof. Optionally, the punch back punching bag may be customized for specific types of training exercises.

According to some embodiments, the punching bag may be attached to a disk by one or more straps, chains, ropes and/or cords. Optionally, a cord may be connected to the disk by a flap, clip, staple, bolt, stiches, etc. and/or a combination thereof. Optionally, the one or more straps may be made from a flexible and/or elastic material. According to some embodiments, the length and/or elasticity of the straps may absorb shocks and/or torque shielding the actuator. Alternatively, or additionally, the bag and/or it's stand may sit on a rotating base.

According to some embodiments, the bag may be supported and/or attached to a rotation source by straps. Optionally, the straps may be of various weights or thicknesses, for example to provide various levels of resistance. Optionally, the straps may be made from canvas, elasticated cord (e.g., bungee cord, etc.), chains, springs, etc. Optionally, the weight of the bag may provide tension on the cords. Optionally, the tension of the cords may be provided by an elastic element. Optionally, the cords may connect the punching bag to one or more axels and/or supports (e.g., upper support beam, base, etc.). Optionally, the cords may connect one punching bag to a second punching bag. Optionally, the cords may connect between two or more punching bags. Optionally, a punching bag may be connected by one or more cords or system of cords from above and from below.

Additionally, and/or alternatively, in an embodiment, the strap may be of various lengths, weights, or thicknesses in order to increase or decrease the swinging of the bag. Optionally, an attachment strap may have a length of between about 1 cm to about 5 cm, and/or between about 5 cm to about 10 cm, and/or between about 10 cm to about 15 cm, and/or between about 15 cm to about 20 cm, and/or between about 20 cm to about 25 cm, and/or between about 25 cm to about 30 cm, and/or between about 30 cm to about 40 cm, and/or between about 40 cm to about 50 cm. In an embodiment, the straps may include one or more clips, for example carabiners. Optionally, the clips may be of various sizes to allow for attachment to various weights of strap, cord, chain, etc., different connectors, etc. Optionally, the clips may be lockable. Optionally, the strap may have a ring or loop on one or both ends, e.g., for connection to a clip and/or disk.

According to some embodiments, the disk may be attached to a rotatable axel. Optionally, the disk may include one or more loops and/or openings to which cords, straps or handles may be attached. Optionally, the axel may rotate in more than one direction, e.g., left, right, etc. Optionally, the height of the axel may be adjusted. Optionally, the rotation and/or the height of the axel may be adjusted electronically. Optionally, the axel may be or may be part of an actuator. According to some embodiments, the rotation and/or the height of the axel may be powered by a motor. Optionally, the axel may be attached to one or more rails, which may adjust the position of the punch back punching bag relative to a user.

According to some embodiments, the motor may be shielded from shocks to the punching bag. Optionally, the weight of the bag may not be supported by the motor, e.g., the axle may be attached to the ceiling and/or the floor and/or a freestanding stand by a bearing which may support the weight of the bag. Optionally, the motor may only produce rotational torque. Optionally, the punching bag may hang off an axel, either directly or through a support member (e.g., a disk). Optionally, the punching bag may hang of the axel and/or disk by one or more straps. Optionally, the rotational torque and/or other shocks may be reduced and/or absorbed by the straps. For example, by the elasticity of the straps and/or by the straps twisting to cause a sideways and/or rotational tension on the bag, and slowly releasing the force with reduced shock.

According to some embodiments, the axel may be attached to the ceiling and/or the floor and/or a freestanding stand and/or bracket and/or base. Optionally, the axel may be attached to a swivel and/or a bearing which may in turn be attached to the ceiling and/or the floor and/or a freestanding stand. Optionally, the axel may be load-bearing. Optionally, the axel may not be load bearing. Optionally, the motor may not be load bearing. Optionally, the motor may be partially load bearing. Optionally, the bearing and/or motor may be attached to a shock absorber and/or swivel which may shield them from translational forces and/or swinging of the bag (e.g., caused by the force of a user's blows).

According to some embodiments, the motor may be a simple DC motor and/or a brushless DC actuator. Optionally, the strength of a blow from the arms may be controlled by the rotational speed of punching bag and/or rotational inertia of the bag. Optionally, the rotational speed of the punching bag may be controlled by the voltage and/or current applied to the motor and/or the direction by the polarity. Optionally, the power may be controlled by PWM (pulse width modulation). Optionally, the position of the motor may be determined (e.g., by an encoder). Optionally, the motor may be controlled by a processor. Optionally, the processor may be programmed to "hit" a user at different velocities, different strengths, different times, control the strength and/or angle and/or angular velocity and/or torque of the bag as a function of time and/or angle. Optionally, the processor may be pre-programmed (e.g., may have various programs with various degrees of difficulty. Optionally, the processor may by controlled by a dedicated remote control, e.g., a linked joystick and/or an app on a remote device (e.g., a cellular phone, tablet, laptop, desktop, smart phone, VR, etc.). Optionally, a trainer may control the punch back punching bag manually, through an app, joystick, dedicated remote control, etc. Optionally, as the user is training, a trainer may use the remote control to control the bag live. For example, when the trainer sees that the user is letting down his guard, the trainer may activate the bag to give a blow to the user to his unguarded side etc. Optionally, the remote control may be used to control the timing, direction and/or speed of rotation of the bag. Optionally, the timing of a blow by the punch back punching bag may be controlled directly by a trainer using a joystick and/or may be programmed and/or may be random. In some embodiments, the blows from the bag may be reactive to the user (e.g., blows that the bag receives from the user, movements of the user etc.).

Advantageously, a motor may be used such that the arms can be set to "hit" back at the user with various amounts of force, including heavy blows. Optionally, the motor may be attached to the ceiling, the floor and/or a freestanding stand, e.g., on the floor or on a special base. Optionally, a motor may rotate the punching bag from below and/or above.

According to some embodiments, the punch back punching bag may include one or more cameras. Optionally, a camera may be connected to a processor. Optionally, the camera may be used to analyze and/or identify when a user is not protecting some part of their body, e.g., their face. For example, the system may include hardware and/or software that analyzes movements of the user and activates the bag to hit him in response to his movements. For example, the bag system may be programmed to recognize when the user has let down his guard (e.g., is not holding his hand up by his face) and hit him on an unguarded side. Optionally, the camera may be connected to or may be separate from the controller which moves the bag. Optionally, the camera may be used to analyze and/or identify weaknesses in a user's style. Optionally, the controller may target one or more weaknesses in the user's style detected by the camera.

According to some embodiments, the punch back punching bag may include one or more sensors. Optionally, the one or more sensors may be located on and/or within the punching bag. Optionally, one or more sensors may be attached to a strap and/or belt and/or jacket that wraps around the punching bag. For example, the strap may be wrapped around the bag and/or tied to the bag and/or clasped to the bag. Optionally, the one or more sensors may be moved up or down along the length of the punching bag. Optionally, the one or more sensors may be adjusted and/or replaced, e.g., to be closer together or further apart to fit a child, teenager, or adult, etc.

According to some embodiment, the one or more sensors may be connected to a processor. Optionally, each motor may be controlled by a separate processor. Optionally, one or more processors may be linked and/or act individually or in concert.

According to some embodiments, the processor may include an artificial intelligence (AI) algorithm. Optionally, the AI algorithm may analyze the number and/or identify and/or detect a user's blows (e.g., angle, strength, direction, style, favor, etc.). Optionally, the one or more sensors may be a power meter. Optionally, the one or more sensors may be connected to and/or may be separate from the processor which moves the bag. Optionally, the one or more sensors may provide data to a processor which may be used to analyze and/or identify weaknesses in a user's style. Optionally, the processor may target one or more weaknesses in the user's style detected by the one or more sensors. Optionally, the AI algorithm may be programmed with an opponent's style, weaknesses and/or preferred tactics, and to provide a training regime (e.g., speed, power, tactics, etc.) accordingly. Optionally, the AI algorithm may identify the user's level of skill and provide a suitable training regime accordingly. Optionally, the system may include tactics (e.g., pre-programmed or AI). For example, when the user hits with the right hand it may understand that the right side of user is probably unprotected, etc.

According to some embodiments, if a sensor detects a hit to the punching bag by a user, then the sensor may stop the motor for a period of time (e.g., a second, a second and a half, etc.) during which time the arms may not hit the user.

According to some embodiments, the punch back punching bag may include one or more target markers. Optionally, the one or more target markers may be illuminated marks on the punching bag. Optionally, the illuminated marks may include one or more sensors (e.g., thereunder). Optionally, when a sensor detects a blow from a user it may illuminate. Optionally, illuminated markers may turn on, thereby providing targets for a user to hit, and may optionally dull once a sensor detects a hit, thereby increasing a user's accuracy. Optionally, a user may have a time limit to hit an illuminated mark, e.g., a user may have to hit the illuminated area within a second. Optionally, the markers may be illuminated randomly, manually, pre-programmed and/or programmed with various levels of difficulty. Alternatively, or additionally, a marker may be controlled by a processor that actuates the marker and/or sensor in accordance with a strategy. For example, the strategy may be in accordance to actions of the bag (e.g., a marker for a blow to the right may be lit after the bag makes a blow with his right arm [e.g., simulating a chance to hit a boxer when his right guard is down after hitting with his right hand]) and/or the processor may be connected to a camera and/or light markers in response to actions of the user. Optionally, the bag may include at least 3 markers, at least 5 markers, at least 7 markers, at least 10 markers or at least 15 markers which may be illuminated. Optionally, the positions of the markers may be adjusted e.g., according to a user's height, reach, etc. Optionally, on some of the markers may be illuminated during a training session. Optionally, the markers may be designed to be programed to train a user to be faster and/or more precise and/or more agile and/or a combination thereof. For example, when the markers are illuminated turn on, the punching bag may be rotated at the same time to gives blows and make it difficult for a user to hit the markers.

In one embodiment, the punch back punching bag may be customized for specific types of training e.g., to work specific muscles, sets of muscles, to perform specific exercises, to improve specific skills (such as power, agility, precision, speed, timing, rhythm, etc.) and/or a combination thereof.

According to some embodiments, the punch back punching bag may be used as a game, e.g., in a game arcade. Optionally, a user may score points by hitting one or more markers, by blocking and/or avoiding blows from one or more arms, by the speed, strength and accuracy of their blows, etc. Optionally, one or more sensors in the punch back punching bag may detect blows. Optionally, one or more sensors may detect blows to one or more markers. Optionally, the one or more sensors may detect the speed, strength, and accuracy of their blows, etc. Optionally, the one or more sensors may be located in designated areas of the punch back punching bag, e.g., head, left/right rib, left/right hand, etc. Optionally, the one or more sensors may be connected to a processor. Optionally, the processor may facilitate real time tracking of data received from the one or more sensors.

In an embodiment, the punch back punching bag may be connected to a processor. Optionally, the processor may include various levels which a user may advance through, e.g., increasing in speed, and/or complexity, and/or strength, etc. Optionally, the processor may be connected to a motor of the punch back punching bag. Optionally, the processor may be configured to activate the motor. Optionally, the processor may be configured to rotate the punch back punching bag. Optionally, the processor may be configured for various power levels, e.g., child, normal, professional, etc. Optionally, each power level may include its' own power threshold. Optionally, the power threshold may be pre-determined and/or pre-programmed. Optionally, the processor may be configured for various speeds, e.g., slow, medium, fast, etc. Optionally, each speed may include its' own speed threshold. Optionally, the speed threshold may be pre-determined and/or pre-programmed.

In some embodiments, the user may be provided with a helmet. Optionally, the helmet may include one or more helmet sensors. Optionally, the one or more helmet sensors may be connected to the processor. Optionally, the helmet sensors may register a punch when the punch back punching bag lands a hit on the users' helmet. Optionally, if the helmet sensor does not detect a hit, then the processor may register that the user blocked the hit and/or dodged the blow, e.g., blocked the hit with their hand.

In some embodiments, the user may be provided with a pair of gloves and/or elbow guards and/or knee guards. Optionally, the gloves and/or elbow guards and/or knee guards may include one or more user sensors. Optionally, the user sensors may register a punch when the user lands a hit on the punch back punching bag. Optionally, the user sensors may detect the speed, power and/or location of the hit. Optionally, if the user sensors do not detect a hot, then the processor may register that the punch back punching bag blocked the hit and/or missed the punch back punching bag.

In some embodiments, the processor may be connected to a display screen, e.g., LCD screen. Optionally the display screen may include UI/UX animations. In some embodiments, the processor may track a health of the punching bag. Optionally, the display screen may display statistics of the user and/or the game, e.g., a health bar of the punching bag, health bar for the user, the number of punches and/or hits, real time power of a single punch and/or hit of a specific user, summed power of all punches in a game and/or training session, strongest hit in a single game and/or training session, etc. Optionally, a health bar may indicate the number and/or power of the punches and/or hits, e.g., the health of the punch back punching bag may decrease based on the power of a punch and/or hit. Optionally, the game and/or training session may end and/or the player may be credited with a knock out when the health bar of the punch back punching bag reaches a low enough point zero. Optionally, the processor may store the highest score/s for each level and/or overall game, e.g., the top 10 scores. Optionally, these scores may be replaced if a higher score is achieved.

In some embodiments, the game and/or training session may last a designated time. Optionally, the game and/or training session may include one or more designated periods of activity and one or more rest periods, e.g., 2 minutes of activity (round 1), then 30 seconds rest break, and then 2 minutes of activity (round 2).

In an embodiment, the mechanical punching bag may include one or more safety features. Optionally, the processor may pause the match and/or training session if a punch and/or hit is not detected for more than a pre-selected amount of tome, e.g., 10 seconds. Optionally, if a safety feature is engaged, the system may provide an audio and/or visual query and/or instruction to the user.

In some embodiments, the game and/or training session may rotate slowly to initiate a fist bump, e.g., to indicate that the user is ready to begin. Optionally, the processor may provide audio feedback throughout the game and/or training session through one or more external speakers. Optionally, the processor may be connected to one or more speakers. Optionally, the processor may provide visual feedback through the display and/or one or more lights, etc.

In some embodiments, the audio and/or visual feedback may identify as the match referee. Optionally, the referee may provide instructions and/or encouragement to the user, e.g., start of a game, instruction to fist bump, instruction to touch gloves, instructions to hit harder, time out, end of a round, game over, declare a winner, etc. Optionally, referee may indicate if a punch or hit is below a pre-selected threshold, e.g., the users' punch is too weak. Optionally, the referee may indicate if a punch and/or hit is above a pre-selected threshold, e.g., the users' punch is too strong.

In some embodiments, the feedback may be in the form of audio and/or visual effects, such as a bell and/or light to start or end a round, a knocking sound to instruct the user to prepare for the next round or that a round is near its end, at a pre-determined time prior to the start of the round (such as, 10 seconds before the beginning or end of the round).

In some embodiments, the punch back punching bag may include a user interface. Optionally, the user interface may be a remote control. Optionally, the user interface may be an app. Optionally, the user interface may be a touch screen located on or in the vicinity of the punch back punching bag. Optionally, the user interface may include an LCD screen, a touch screen, speakers, animations, a kill switch, sensors, a start and/or stop button, a token collector, etc. Optionally, the user interface may include one or more menus from which a user may select one or more settings for the punch back punching bag, e.g., to select the power level (such as, child, normal, professional, etc.), hit frequency (such as, slow, medium, fast, etc.), health level (such as, low, medium, high, etc.), hit pattern (e.g., 1, 2, 3, etc.) or any combination thereof.

In some embodiments, the game may be connected to one or more additionally punch back punching bags. Optionally, the additional punch back punching bags may be located in the same physical location (e.g., side by side, etc.) and/or in different physical locations (e.g., in different parts of a city, country, different countries, etc.). Optionally, the game may be played as a competition between two or more individuals sequentially and/or simultaneously. Optionally, the winner of the game may receive a prize. Optionally, the game may be observed physically and/or remotely. Optionally, the game may be recorded and/or replayed.

In an embodiment, the punch back punching bag and/or various components thereof may comprise materials such as metal for example stainless steel, cast iron, zinc alloy, plastic which may be hardened plastic, thermoplastic, polyurethane, polycarbonate, polyethylene, polypropylene, polyethylene terephthalate, polyvinyl chloride, etc. and/or combinations thereof. Optionally, the punch back punching bag may be made from an easy to clean material.

In an embodiment, all or part of the components of the punch back punching bag may be made from recycled materials. In an embodiment, all or part of the components of the punch back punching bag may be recyclable.

In an embodiment, the punch back punching bag may include components of various sizes and colors, which may be color coded for visual appeal and/or as a system to indicate the degree of resistance and/or difficulty.

In an embodiment, the punch back punching bag may comprise an instruction manual explaining how to use the punch back punching bag and/or providing instruction on the programs suggested for each level of difficulty and/or training type. Optionally, one or more manuals describing exercises of increasing difficulty may be included with the punch back punching bag and/or may be purchased separately.

Specific Embodiments

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

The present invention, in some embodiments thereof, relates to motorized boxing bag, and, more particularly, but not exclusively, with arms.

Reference is now made to the figures.

FIG. 1 is an exemplary photograph of a prior art punching bag with mechanical arms. For example, the mechanical arm 10 comprise an actuator 14 at the connection of the arm 10 to the punching bag 12. The actuators can be fragile and small, and can therefore be easily damaged and/or provide weak blows to the user. Due to the size and/or strength of the actuators, a user may be required to hold back on the power of their blows so as not to damage the actuators, thereby both defeating the purpose of training on a punching bag and training bad habits into a user.

Figure 2A:
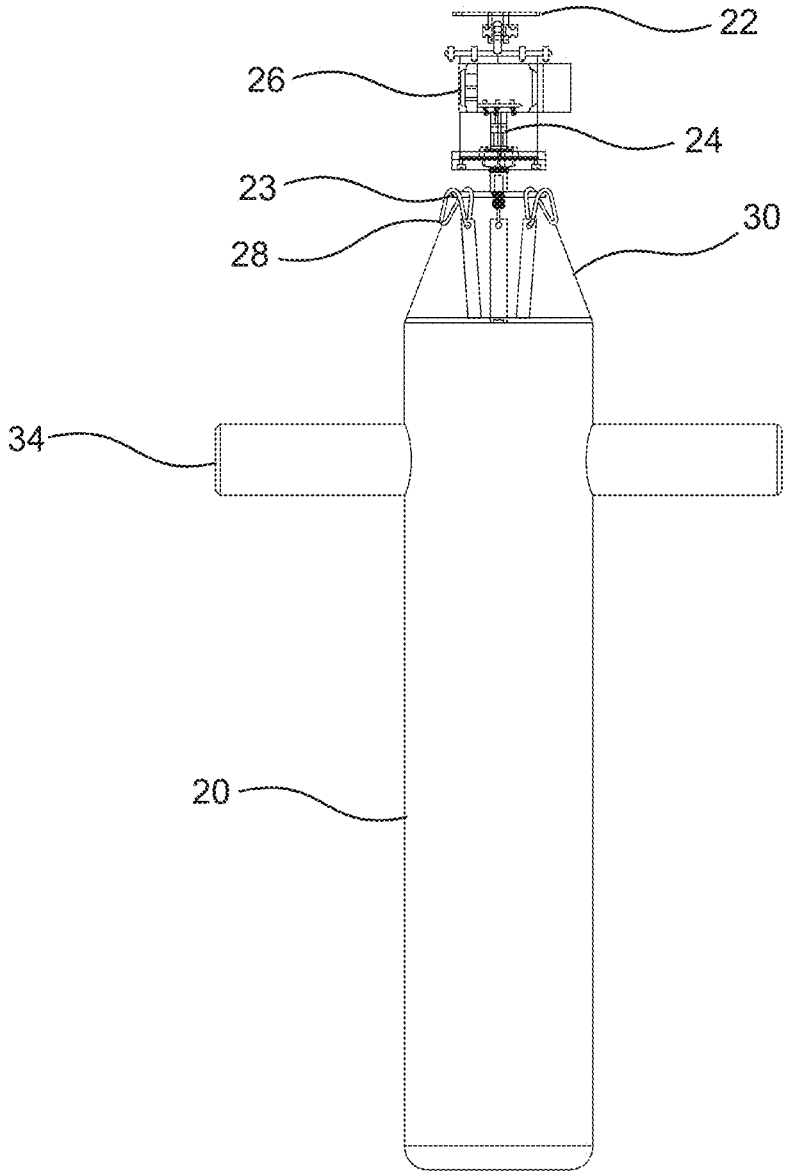
FIG. 2A-C are front view, side view and perspective view, respectively, of a schematic diagram illustrating a punching bag, in accordance with an embodiment of the current invention.
Figure 2B:
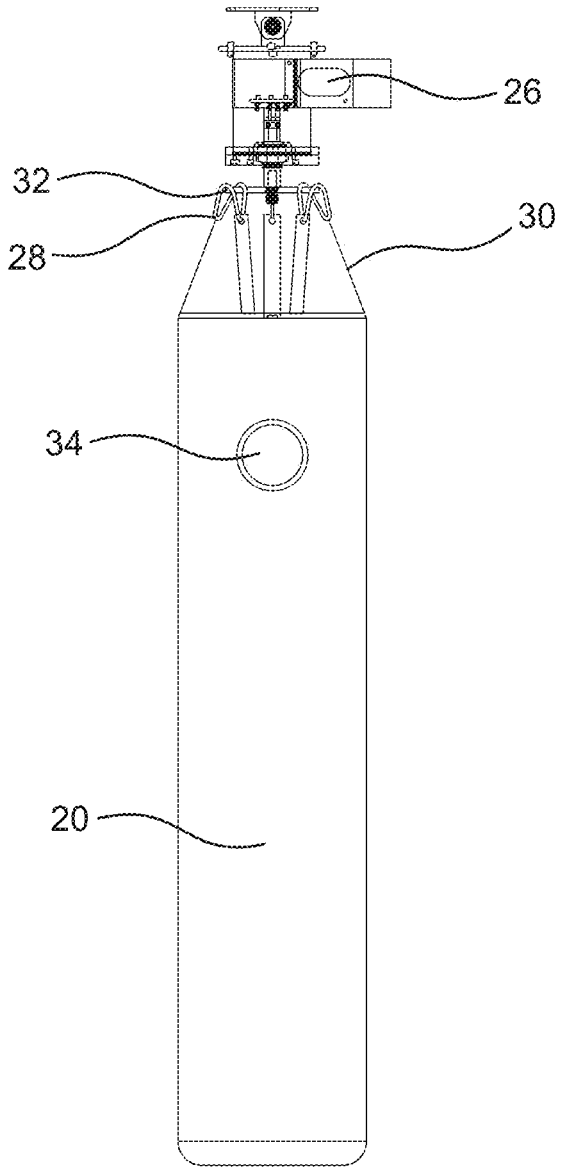
Figure 2C:
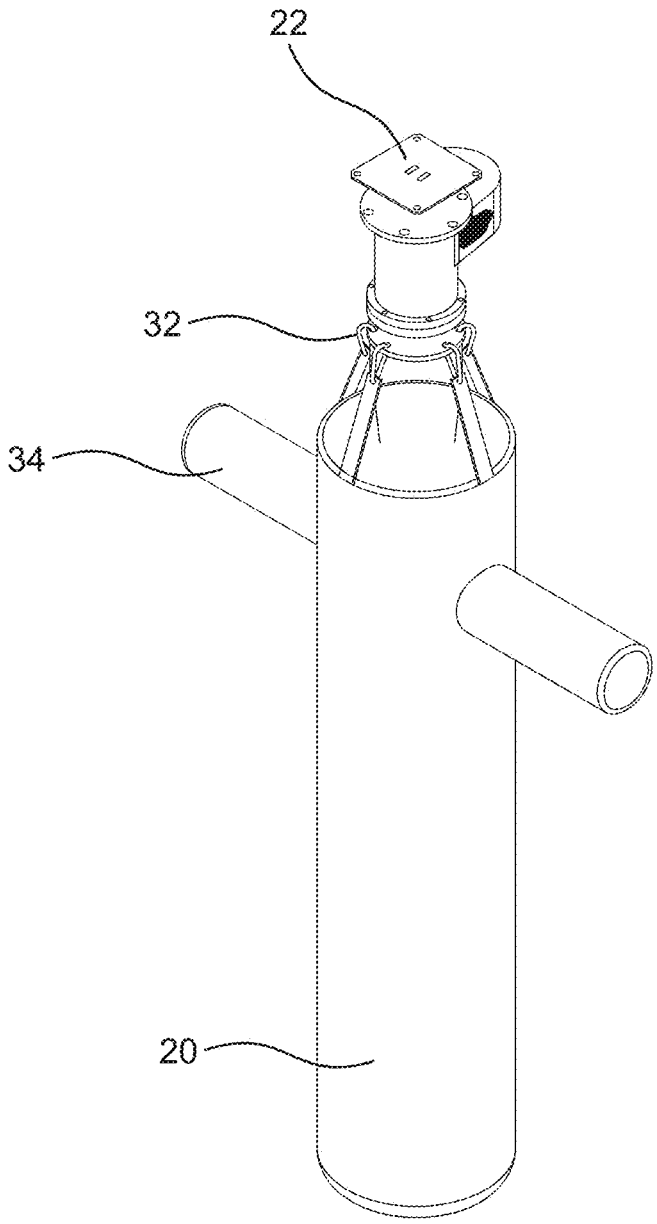

FIG. 2A-C are front view, side view and perspective view, respectively, of schematic diagrams illustrating a punch back punching bag in accordance with an embodiment of the current invention. For example, a punching bag 20 suspended from the ceiling by a bearing 22 and a swivel connected to a rotatable axel 24 with a motor 26, attached by one or more clips 28 and straps 30 through a disk 32 to the punching bag 20 with reversibly attachable arms 34. Optionally, the arms may not include an actuator. Optionally, the size and/or length and/or weight and/or amount of padding of the arms may be adjusted, e.g., depending on the height, experience, weight and/or reach of the user. Optionally, the one or more arms may be attached to the punching bag to mimic the blows of an opponent, e.g., at the height of an anticipated opponent, etc. Optionally, the one or more arms may be attached to the punching bag to mimic blows from an opponent's fists, elbows, thighs, knees and/or feet, and/or a combination thereof. For example, an arm attached to a bag may weigh between 0.1 to 1 kg and/or between 1 to 2 kg and/or between 2 to 4 kg and/or between 4 to 8 kg and/or between 8 to 20 kg. Optionally, the center of gravity of the arm may be on the proximal half of the arm (closer to the bag) and/or on the distal half of the arm and/or on the proximal ¼ of the bag and/or on the distal ¼ of the bag and/or near the middle of the arm. In some embodiments, the arm may be elastic and/or plastic and/or stiff. For example, the arm may be filled with foam and/or plastic and/or sand and/or gel and/or fluid (e.g., water) and/or gas (e.g., air).

Figure 3A:
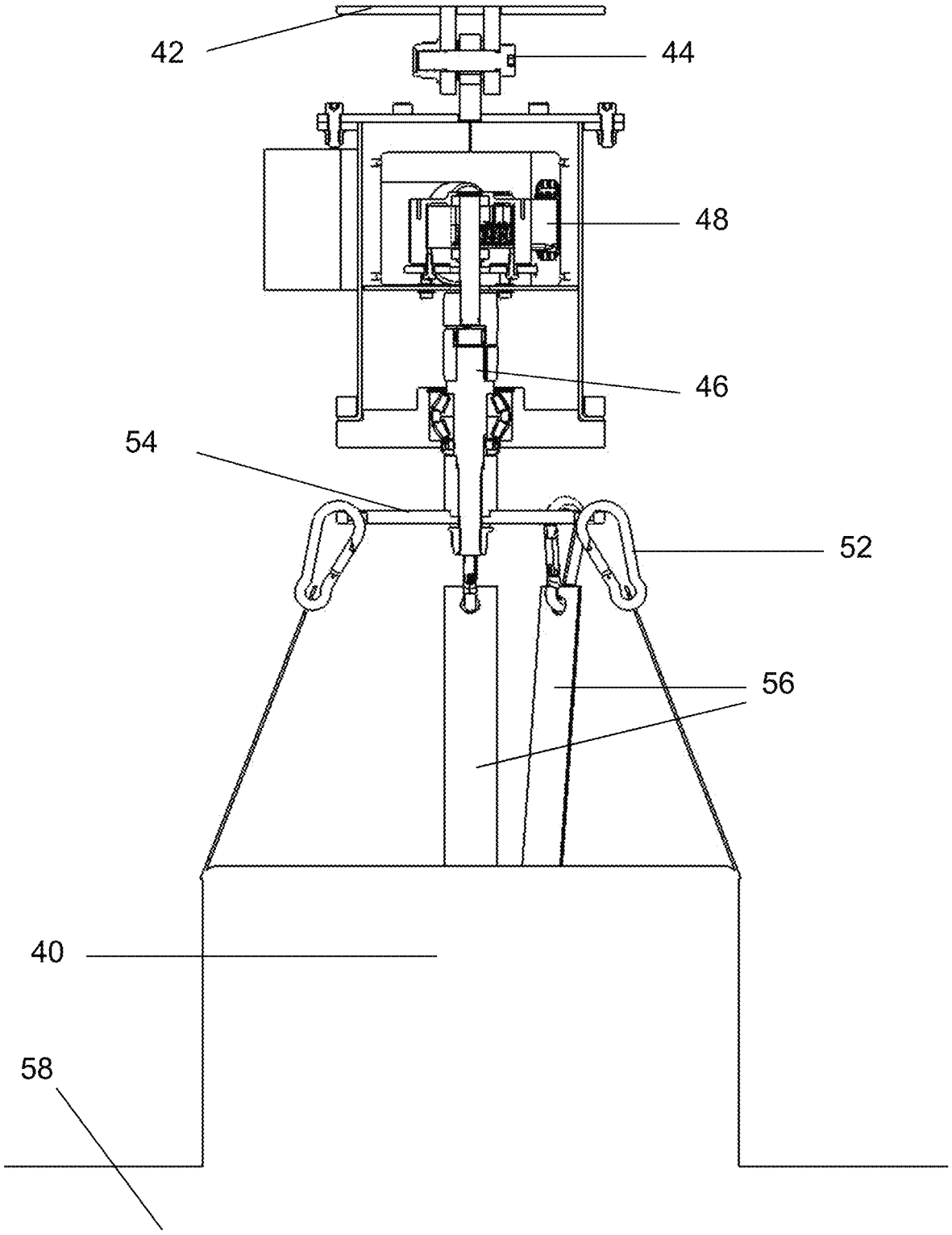
FIG. 3A-C: Cut away views of a schematic diagram illustrating a punching bag, in accordance with an embodiment of the current invention.
Figure 3B:
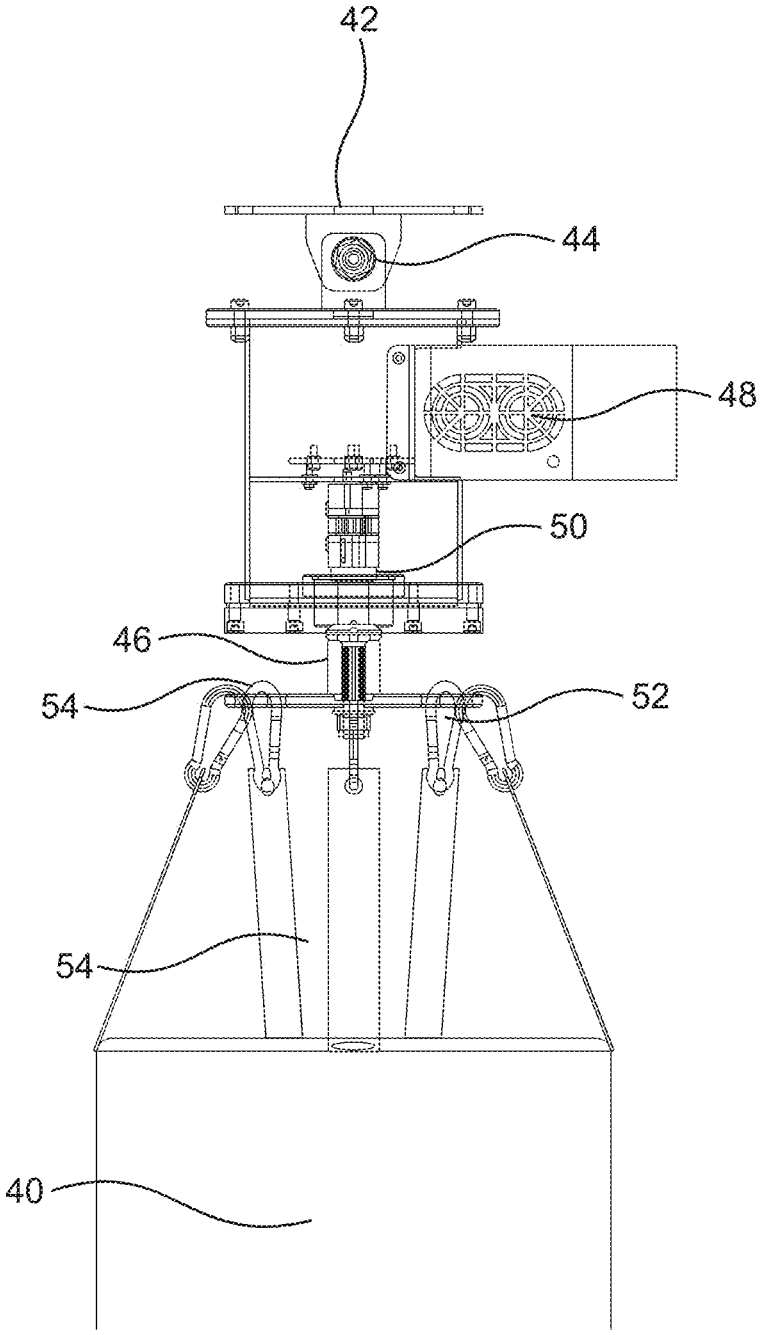
Figure 3C:
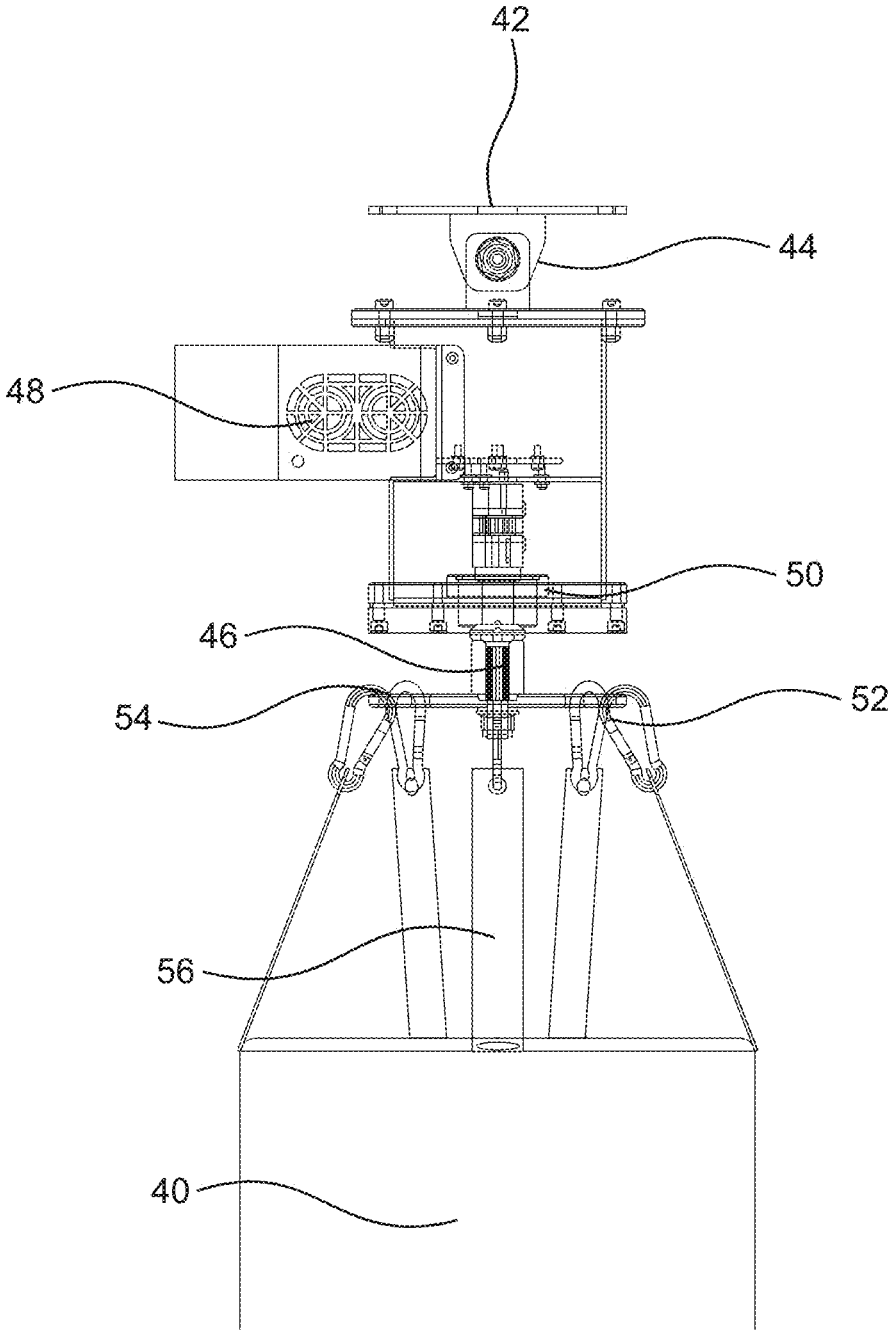

FIGS. 3A, 3B and 3C are cut away views of schematic diagrams illustrating a punch back punching bag in accordance with an embodiment of the current invention. For example, a punching bag 40 suspended from the ceiling (not shown) by a bearing 42 and a swivel 44 connected to a rotatable axel 46 with a motor 48, attached by one or more clips 52 and straps 56 through a disk 54 to the punching bag with reversibly attached arms. Optionally, the motor may be a simple DC motor 48 and/or a brushless DC actuator 50. Optionally, the strength of a blow from the arms 58 may be controlled by the rotational speed of punching bag. Optionally, the rotational speed of the punching bag may be controlled by the voltage and/or current applied to the motor and/or the direction by the polarity. Optionally, the power may be controlled by PWM (pulse width modulation). Optionally, the position of the motor may be determined (e.g., by an encoder).

Optionally, when a motor 48 rotates the disk 54 about the axel 46, the straps 56 are angled and stretched, lifting the punching bag 40 without absorbing shock (without putting sudden torque onto the motor) then the punching bag 40 accelerates rotationally such that when the straps 56 are angled the tension of the straps 56 puts torque on the punching bag. As the punching bag twists back, the straps 56 fall back to be vertical with the disk 54 and moving downward slightly. Therefore, the shock of the rotation is absorbed by the straps 56 and not by the motor 48. Optionally, at rest the straps may be vertical.

Figure 4:
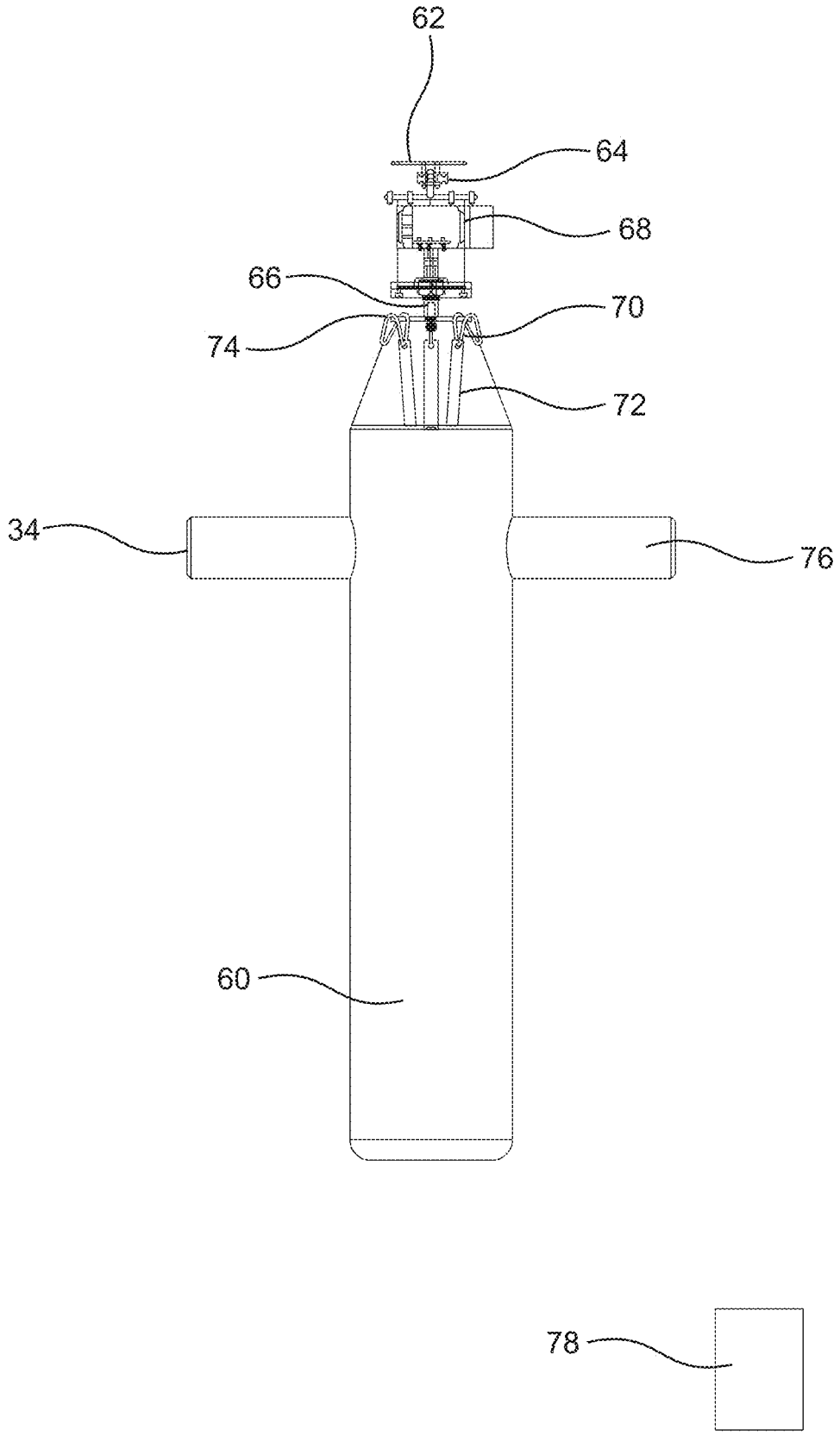
FIG. 4: A schematic diagram illustrating a punching bag and controller, in accordance with an embodiment of the current invention.

FIG. 4 is a schematic diagram illustrating a punch back punching bag and controller in accordance with an embodiment of the current invention. For example, a punching bag 60 suspended from the ceiling (not shown) by a bearing 62 and a swivel 64 connected to a rotatable axel 66 with a motor 68, attached by one or more clips 70 and straps 72 through a disk 74 to the punching bag 60 with reversibly attached arms 76. Optionally, the motor may be connected to a processor. Optionally, the processor may be pre-programmed (e.g., may have various programs with various degrees of difficulty. Optionally, the processor may by controlled by a user interface 78. Optionally, the user interface 78 may be a dedicated remote control, linked joystick, app on a remote device (e.g., a cellular phone, tablet, laptop, desktop, smart phone, VR, etc.), touch screen attached to and/or in the vicinity of a support of the punching bag. Optionally, the punch back punching bag may be controlled by an AI algorithm of the processor. Optionally, a trainer may control the punch back punching bag manually, through an app, joystick, dedicated remote control, etc. Optionally, the timing of a blow by the punch back punching bag may be controlled directly by a trainer using a joystick and/or may be programmed and/or may be random.

Figure 5:
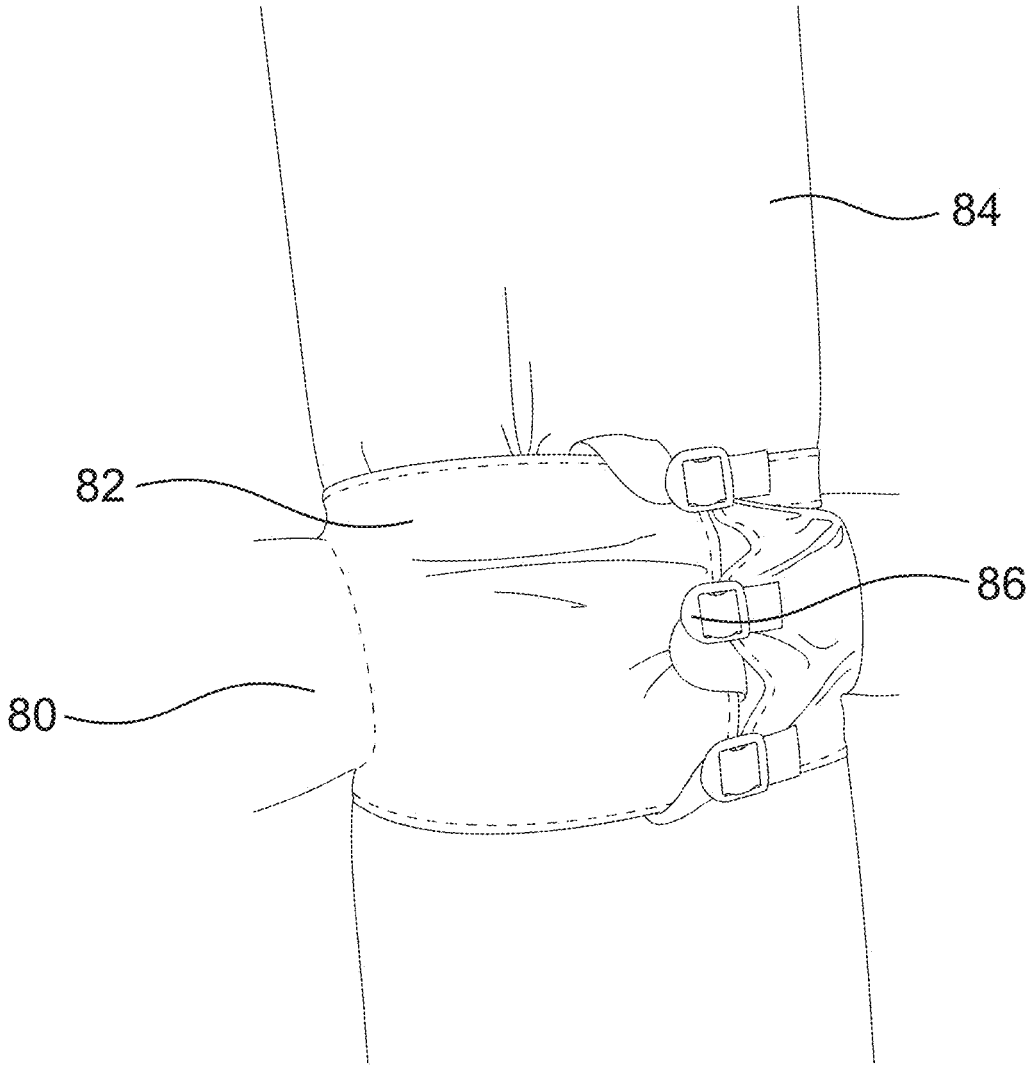
FIG. 5: Perspective view an exemplary photograph of a punching bag, in accordance with an embodiment of the current invention.

FIG. 5 is an exemplary photograph of a punch back punching bag in accordance with an embodiment of the current invention. For example, the one or more arms 80 may be reversibly attached to a punching bag 84 by a belt 82 with one or more fasteners 86. Optionally, the one or more fasteners 86 and/or the belt 82 may be adjustable. Optionally, the one or more fasteners 86 may be lockable.

Figure 6:
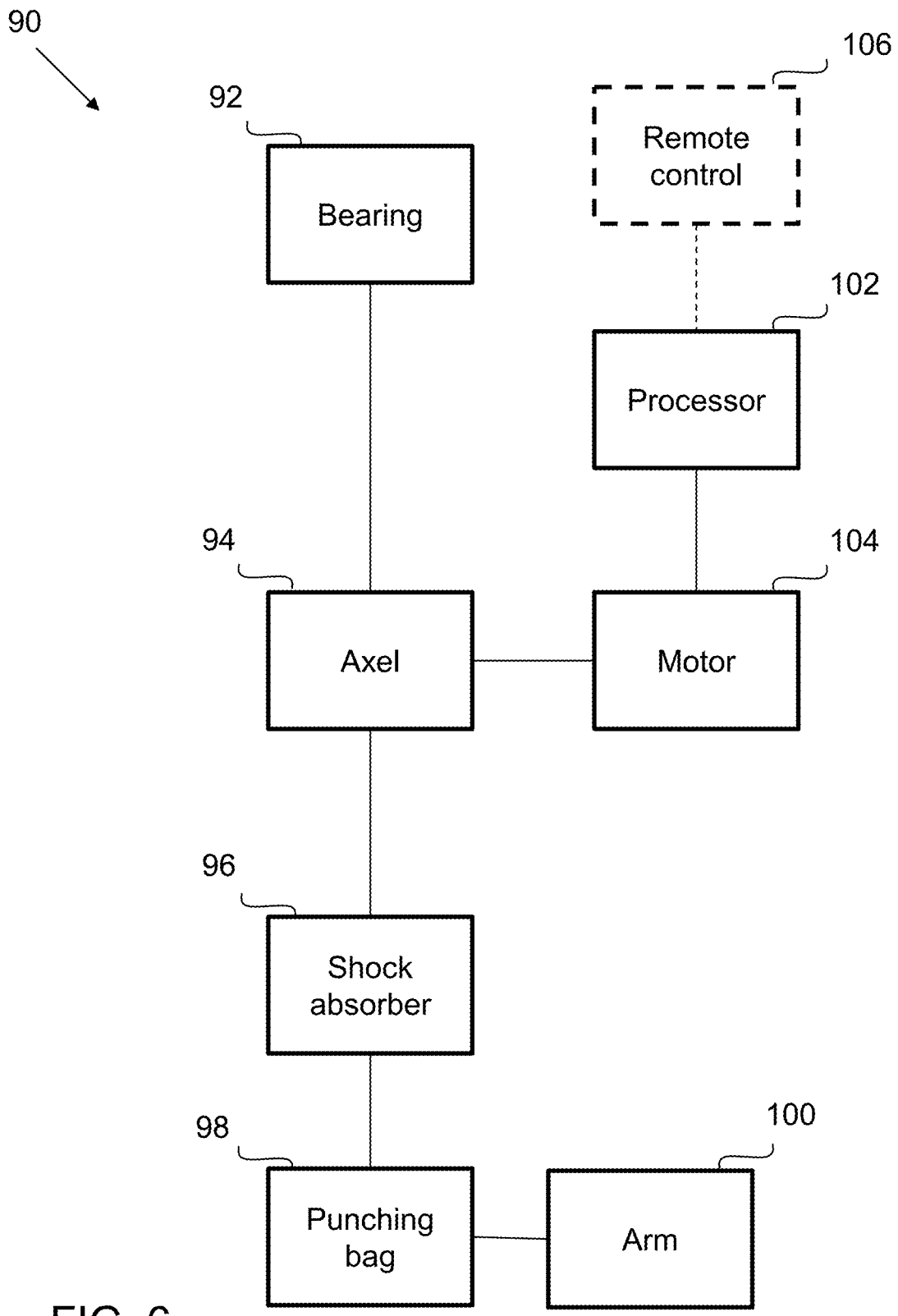
FIG. 6: Block diagram of a punching bag, in accordance with an embodiment of the current invention.

FIG. 6 is a block diagram of a punch back punching bag in accordance with an embodiment of the current invention. For example, the punch back punching bag 90 includes a bearing 92 connected to a support (e.g., a ceiling, floor, stand, bracket, etc.) to support the weight of the punch back punching bag 90, connected to a rotatable axel 94, connected to a motor 104. The motor 104 supplies torque, and is preferably not weight bearing. Optionally, the axel 94 may be attached to one or more shock absorbers 96, e.g., straps and/or a disk which may absorb shock (rotation and/or translation) from a blow. The axel 94 and/or shock absorbers 96 may be connected to a punching bag 98, which is preferably reversibly mounted on the axel 94 and/or shock absorbers 96, to which are attached one or more arms 100, preferably movably and/or reversibly mounted to the punching bag 98. The motor 104 is connected to a processor 102 which may be controlled directly, manually, programmable, pre-programmable and/or optionally, by a remote 106 controlled.

Figure 7:
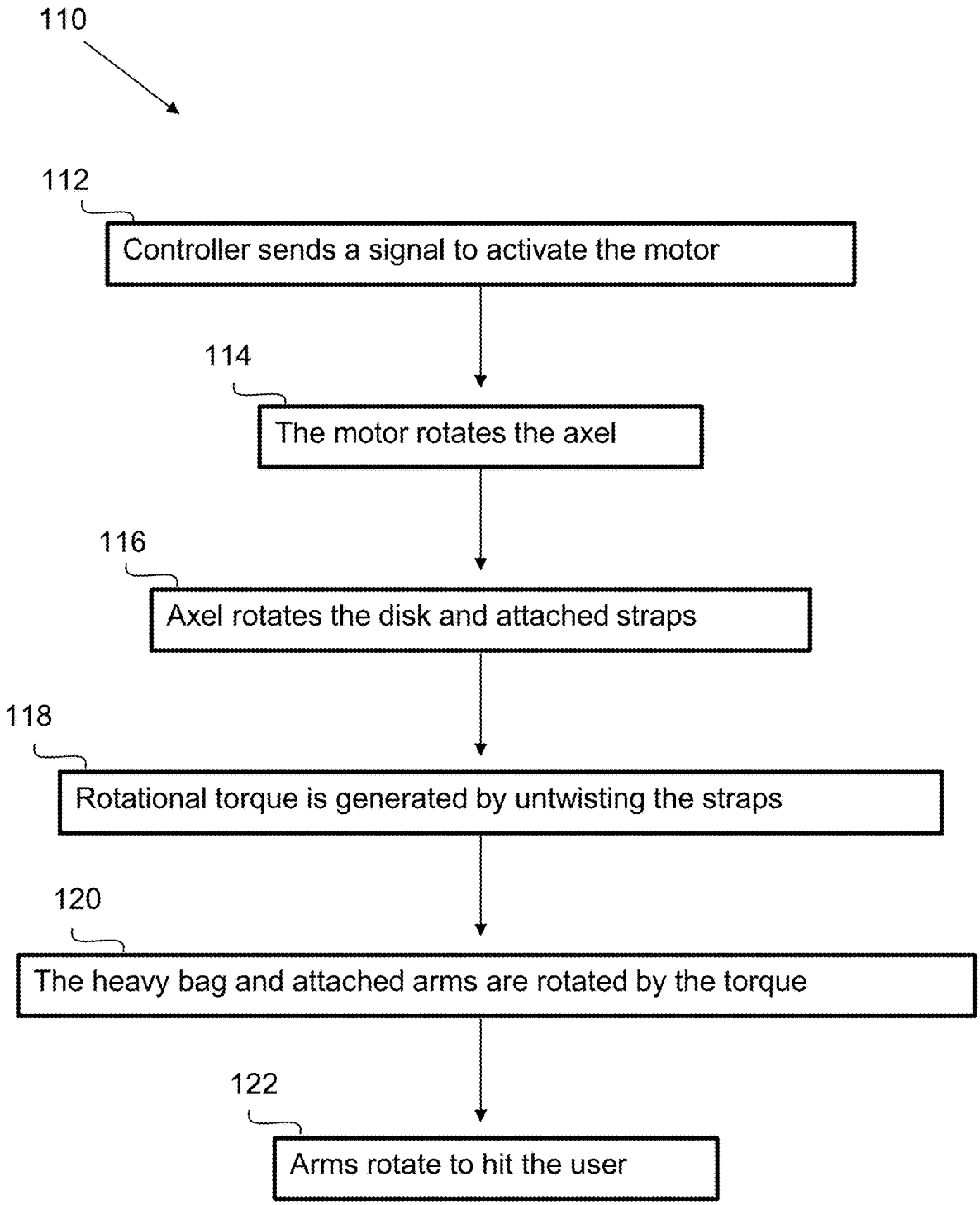
FIG. 7: Flow diagram of a punching bag, in accordance with an embodiment of the current invention.

FIG. 7 is a flow diagram of method for using a punch back punching bag in accordance with an embodiment of the current invention. For example, in method 110, a controller sends 112 a signal to activate a motor, the motor then rotates 114 an axel. The axel may be connected to a shock absorber, such as a disk and straps, which it rotates 116, rotational torque is generated 118 by the axel twisting the straps and then allowing them to untwist, thereby rotating 120 the punching bag and attached arms to hit 122 the user.

Figure 8:
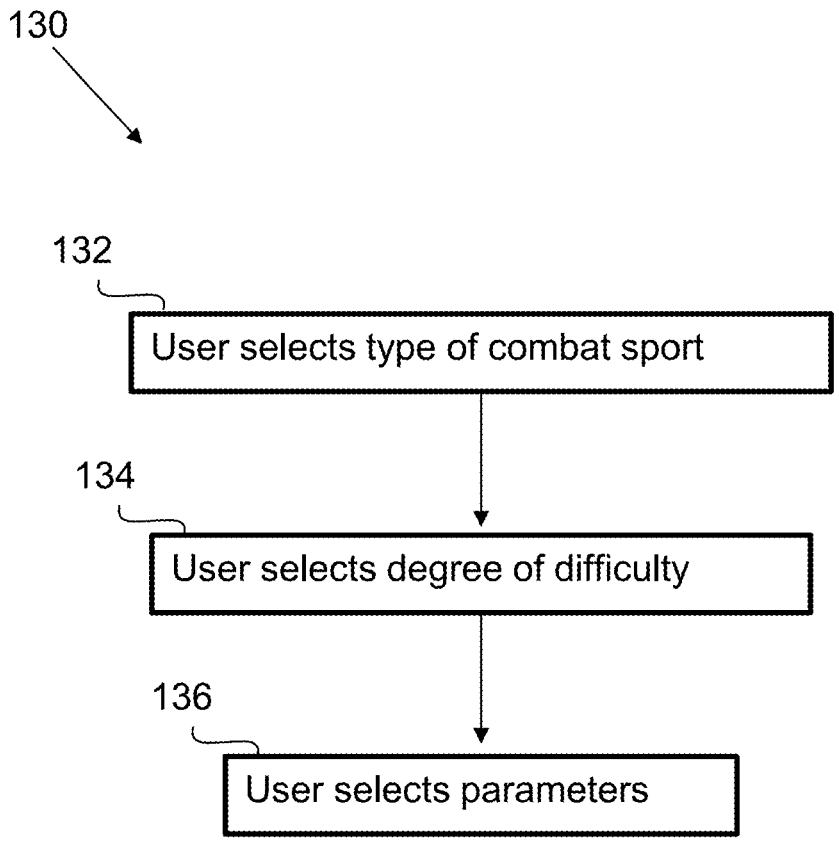
FIG. 8: Flow diagram of a use of a punching bag, in accordance with an embodiment of the current invention.

FIG. 8 is a flow diagram of a method of use of a punch back punching bag in accordance with an embodiment of the current invention. For example, in method 130 prior to beginning a workout, a user may select a workout 132, such as a user may select the type of combat sport for training and/or sparring (e.g., in boxing, kick boxing, MMA, karate, muay Thai, etc.), the user may then select the degree of difficulty 134 and/or the progression (e.g., in beginning of the session, the punch back punching bag may hit slower and/or weaker and may later become more or less aggressive, or hitting back correlated to how hard/fast/etc. the punch back punching bag is hit, etc.), the user may then select and/or input various parameters 136 (e.g., duration of the workout, hit rate of the punch back punching bag, strength of the hit, pause between each hit, the user's height, weight, reach, selected muscle groups to work, etc.).

Figure 9:
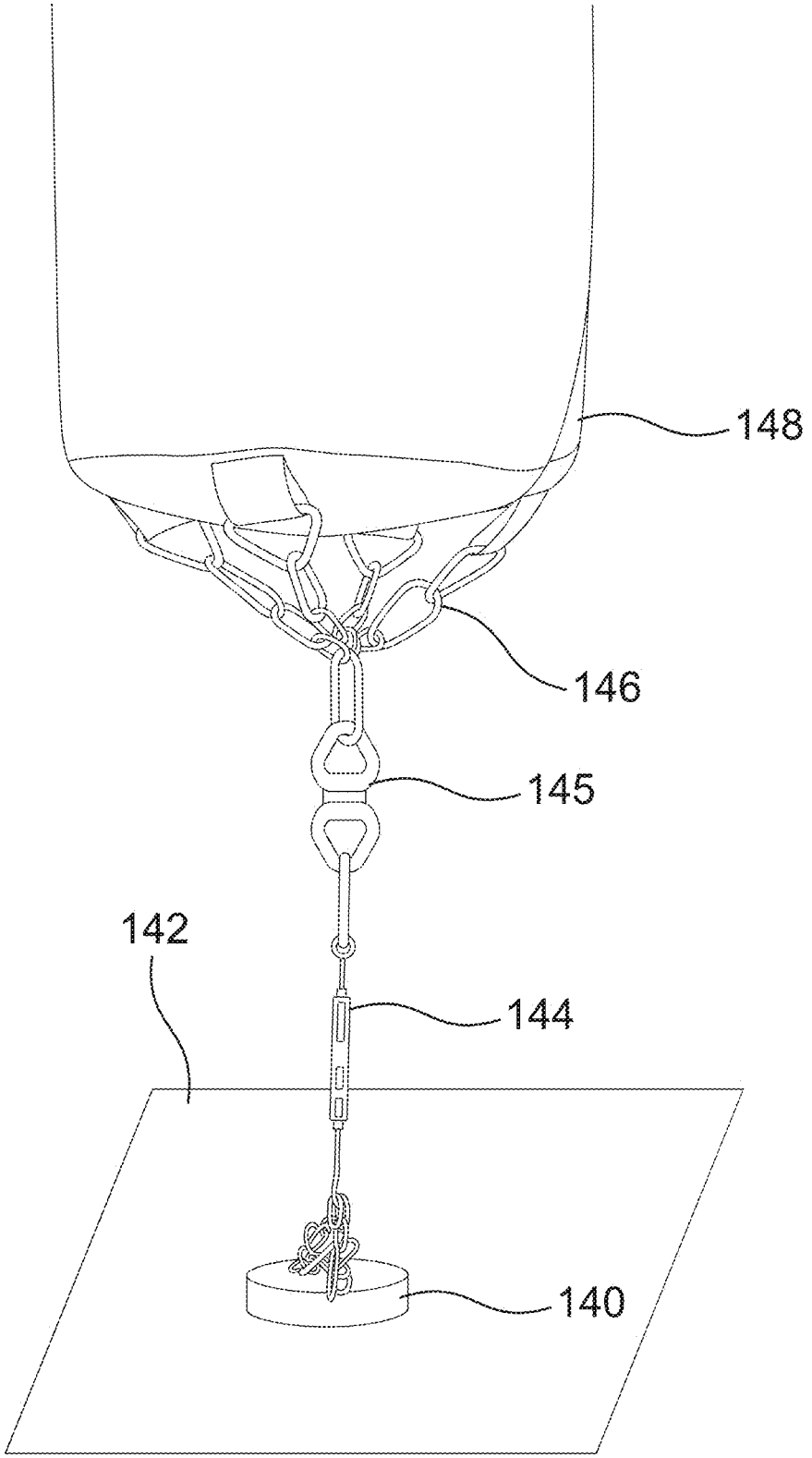
FIG. 9: A schematic diagram illustrating a punching bag and controller, in accordance with an embodiment of the current invention.

FIG. 9 is a schematic diagram illustrating illustrates a bottom of a punching bag attached to a floor in accordance with an embodiment of the current invention. Optionally, the bottom of the punching bag 148 may be free to swing. Alternatively, and/or additionally, the bottom of the punching bag 148 may be attached to a floor 142. Optionally, a bearing 140 between the bottom of the punching bag 148 attachment and the floor 142 may facilitate rotation of the punching bag 148. Alternatively, and/or additionally, there may not be a bearing. In some embodiments, a motor (not shown) may rotate the bottom of the punching bag 148 (e.g., the motor may rotate the bearing 140 and/or a connector (e.g., a turnbuckle 144 (e.g., for tensioning the connection) and/or a swivel 145 (in some embodiments, a connection to a floor will be without a bearing and the swivel 145 will allow rotation of the bag) for an axel connected to the bearing and/or an axel connected to the bottom straps 146 and/or a disk connected to the bottom straps).

Figure 10:
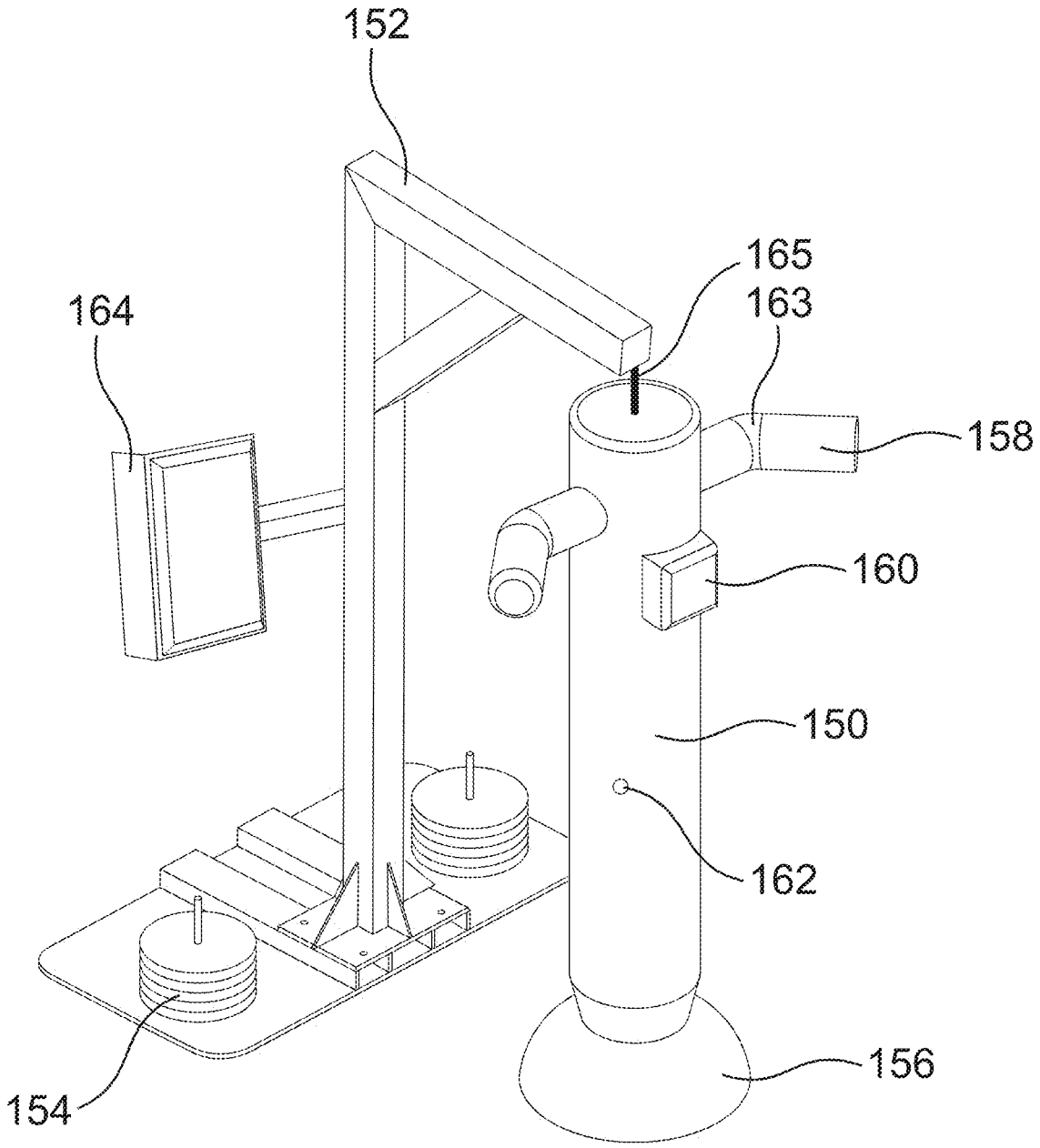
FIG. 10: A schematic diagram illustrating a portable punching bag and controller in accordance with an embodiment of the current invention.

FIG. 10: A schematic diagram illustrating a portable punching bag and controller in accordance with an embodiment of the current invention. For example, a punching bag system may include a punching bag and a controller. The punching bag 150 may be supported by and/or connected to a bearing 156 and/or motor attached to the floor (not shown) at its base. For example, the bag may sit on the bearing 156. Alternatively, or additionally, the bag a connector may support the bag on the bearing and/or connect the bag to the bearing. and connected to a support 152 and ceiling at the top. For example, the bag may be connected to the support 152 and/or ceiling by a tension element (e.g., a chain and/or a strap 165). The support may be attached to a wall, ceiling, floor, and/or may be free standing. The support may include one or more counterweights 154. The punching bag may include one or more adjustable arms 158, a face blow sensor 160 and various additional sensors 162, such as left and/or right body blow sensors. Optionally, the arms may have an elbow 163. Alternatively, or additionally, the arms may be straight. A user interface 164 may be attached to the support and/or may be wirelessly connected to the sensors and/or motor/s. For example, the user interface 164 may include a touch screen and/or a view screen and/or controls and/or indicators and/or a loudspeaker and/or a microphone and/or a camera. Optionally, the interface 164 is positioned where the user and/or a trainer can easily access (e.g., see, hear, and/or interact with [e.g., via touch, voice and/or signals seen by the camera]). For example, in some embodiments, the user interface is held beside the bag 150 on a side of the support 152. Alternatively or additionally, some or all of a user interface may be wireless and/or independent from the support 152 and/or bag 150. For example, the user interface may include a cell phone (e.g., including touch screen, microphone, speaker and/or camera) of a user. In some embodiments, the user interface 164 will be used in a game (e.g., as a scoreboard for example, showing a player's score and/or an opponent's score and/or a health status of the bag etc.)

Figure 11:
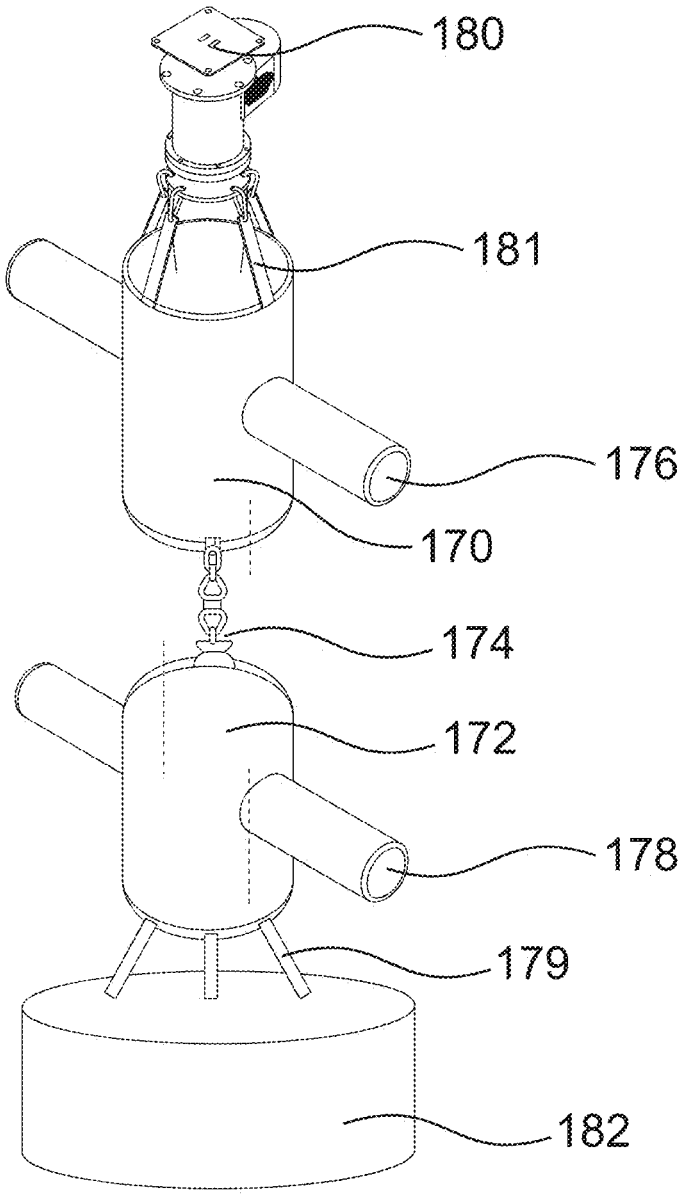
FIG. 11: A schematic diagram illustrating a punching bag system with two punching bags sets, in accordance with an embodiment of the current invention.

FIG. 11 is a schematic diagram illustrating a punching bag system with two punching bags sets in accordance with an embodiment of the current invention. For example, the punch back punching bag may include two punching bags 170, 172 connected to each other. Optionally, the connection may be a chain, a strap, a swivel bearing 174, etc. Optionally, each punching bag 170, 172 may include a set of arms 176, 178. For example, the length of the connector between the bags may range between 0.1 to 1 cm and/or between 1 to 3 cm and/or between 3 to 6 cm and/or between 6 to 12 cm and/or between 12 to 50 cm and/or between 50 to 100 cm. Optionally, each punching bag 170, 172 may be connected to an upper and lower motor 180, 182 respectively. For example, the upper bag 170 may hang from motor 180 and/or a bearing driven by motor 180. Optionally, the upper bag hangs from a strap 181. In some embodiments, all or part of the weight of the lower bag may be supported on the motor 182 and/or a bearing driven by motor 182. In some embodiments, the bag may sit directly on the stand and/or motor 182. Alternatively, or additionally, a connector 179 may connect between the lower bag and the motor 182. For example, the connector may include a tension element (e.g., a strap and/or a chain and/or a rope). Alternatively, or additionally, the connector 179 may include a rigid element (e.g., a bar). Optionally, a connector 179 may support all or part of the weight of the lower bag. Alternatively, or additionally, only one punching bag may be connected to a motor. Optionally, the upper punching bag 170 may be connected to a support and/or to the ceiling. Optionally, the lower punching bag 172 may be connected to the floor and/or to a bearing.

According to some embodiments, the use of two or more smaller punching bags (e.g., with weight ranging between about 2 Kg to about 10 Kg, between about 10 Kg to about 20 Kg, and/or between about 20 Kg to about 50 Kg). Optionally, use of two or more smaller punching bags may make the punching bag system easier to transport and/or install. Optionally, use of two or more smaller punching bags may make the system more unpredictable and/or faster, e.g., as the same size motor may be used to rotate a lower weight than a single heavy bag. Optionally, use of two or more smaller punching bags may allow the use of a smaller motor/s.

Figure 12A:
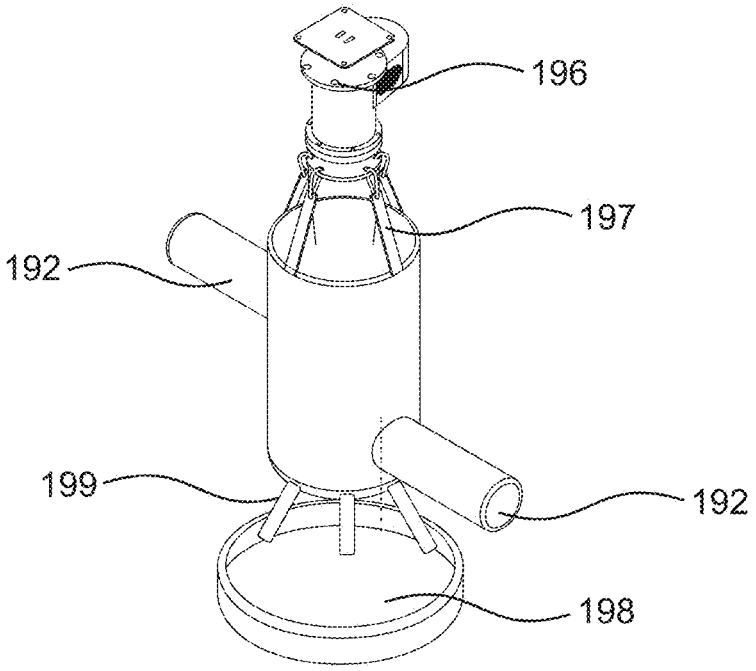
FIGS. 12A and 12B: Schematic diagrams illustrating rotation of a punching bag with asymmetric arms, in accordance with an embodiment of the current invention.
Figure 12B:
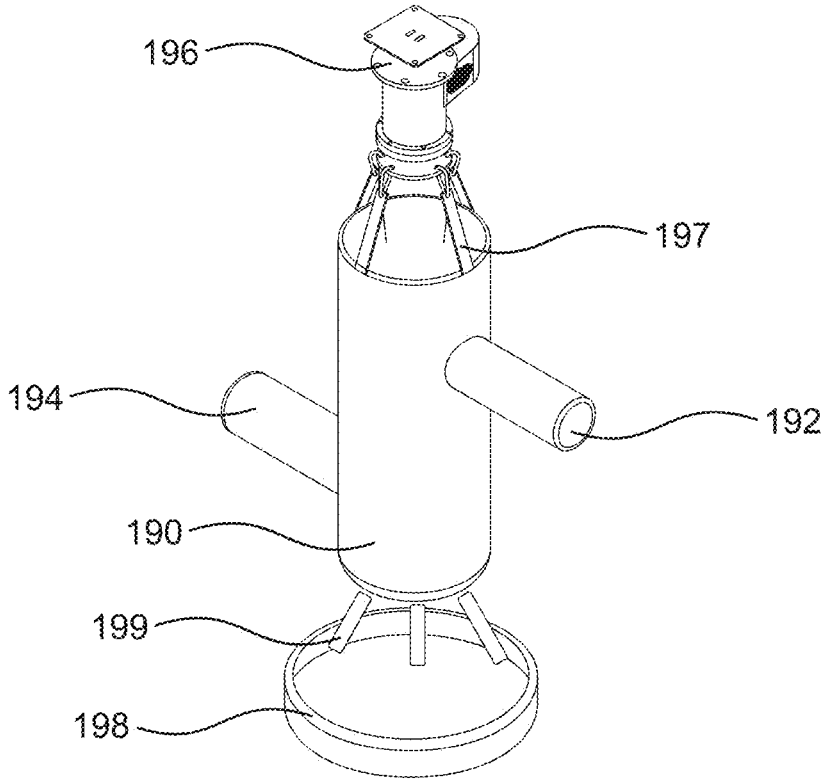

FIGS. 12A and 12B are schematic diagrams illustrating rotation of a punching bag with asymmetric arms, in accordance with an embodiment of the current invention. According to some embodiments, the arms may be attached to the punching bag symmetrically and/or asymmetrically. For example, the arms 192, 194 may be attached to the punching bag 190 asymmetrically, such as ab upper arm 192 at head height and a lower arm 194 at body height. Optionally, the punching bag may be connected to a motor 196 and/or a bearing driven by motor 196 at a first end, e.g., top. A tension element (e.g., a strap 197 may connect between the bearing 198 and the bag. Additionally, or alternatively, the bag may be connected to a bearing 198 and/or a motor at the second end, e.g., bottom. Optionally, the punching bag is connected to a rotating stand. Optionally, all or part of the weight of the bag may be supported on the bearing 198 and/or stand. In some embodiments, the bag may sit directly on the stand and/or bearing 198. Alternatively, or additionally, a connector 199 may connect between the bag and the stand and/or bearing 198. For example, the connector 199 may include a tension element (e.g., a strap and/or a chain and/or a rope), optionally, all or part of the weight and/or tension may be supported by the upper bearing and/or motor 196. Alternatively, or additionally, the connector 179 may include a rigid element (e.g., a bar). Optionally, a connector 199 may support all or part of the weight of the bag.

For example, the punching bag may be rotated right such that the punching bag aims a blow to the head from the right and then rotated left to aim a blow at the body from the left (e.g., FIG. 12A). After a 180° rotation of the punching bag, the punching bag may be rotated left such that the punching bag aims a blow to the head from the left and then rotated right to aim a blow at the body from the right (e.g., FIG. 12B).

Figure 13A:
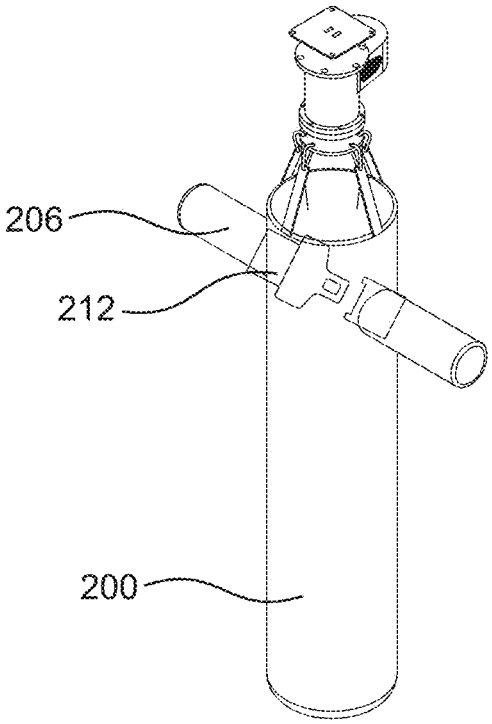
FIGS. 13A and 13B: Schematic diagrams illustrating a punching bag and removable arms, in accordance with an embodiment of the current invention.
Figure 13B:
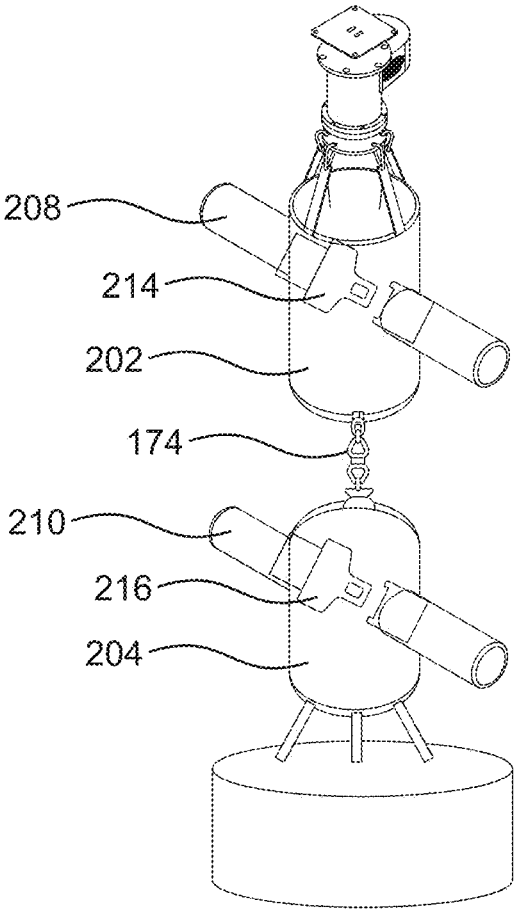

FIGS. 13A and 13B are schematic diagrams illustrating a punching bag and removable arms, in accordance with an embodiment of the current invention. For example, punching bag 200, 202, 204 may include a set of removable arms 206, 208, 210, which may be attached to the punching bag 200, 202, 204 by a fastener 212, 214, 216. Optionally, the one or more fasteners may be adjustable. Optionally, the one or more fasteners may be lockable. Optionally, the one or more fasteners may be clips. Alternatively, and/or additionally, an arm may be attached to a strap and/or belt and/or jacket that wraps around the punching bag. For example, the strap may be wrapped around the bag and/or tied to the bag and/or clasped to the bag. Optionally, the arms may be moved up or down along the length of the punching bag. Optionally, the arms may be switched, e.g., for smaller arms to fit a child, such as face closer to body, arms shorter.

Figure 14:
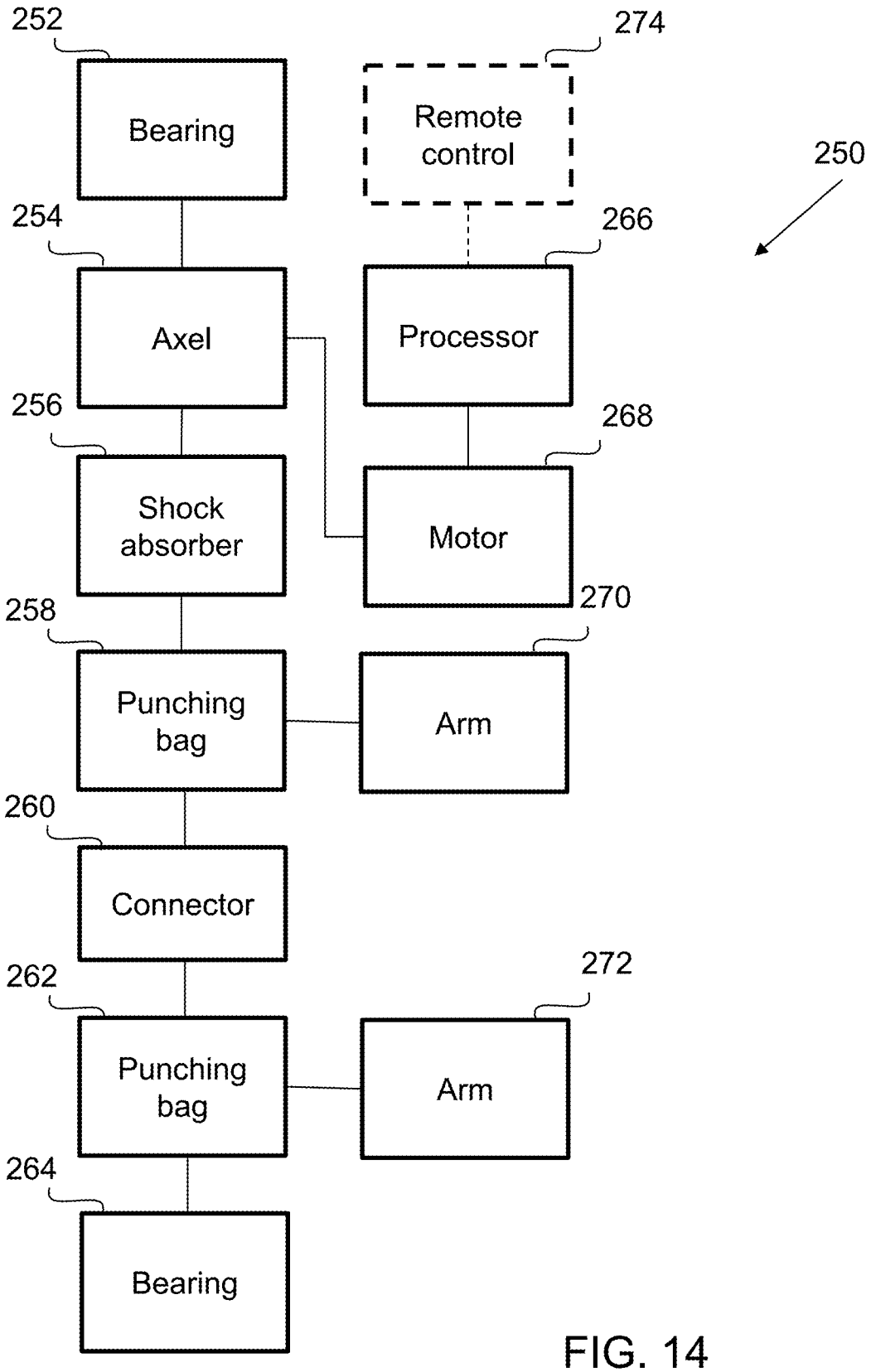
FIG. 14: Block diagram of a punching bag in accordance with an embodiment of the current invention.

FIG. 14 is a block diagram of a punching bag in accordance with an embodiment of the current invention. For example, the punch back punching bag 250 includes a bearing 252 connected to a support (e.g., a ceiling, floor, stand, bracket, etc.) to support the weight of the punch back punching bag 250, connected to a rotatable axel 254, connected to a motor 268. The motor 268 supplies torque and is preferably not weight bearing. The motor 268 is connected to a processor 266, which may be controlled directly, manually, programmable, pre-programmable and/or optionally, by a remote 274 controlled. Optionally, the axel 254 may be attached to one or more shock absorbers 256, e.g., straps and/or a disk which may absorb shock (rotation and/or translation) from a blow. The axel 254 and/or shock absorbers 256 may be connected to a first punching bag 258, optionally through a disk and cone or more clips. One or more arms 270 are adjustably and/or reversibly mounted to the first punching bag 258. The first punching bag 258 may be connected by a connector 260 to a second punching bag 262 or to a bearing and/or to the floor. The connector 260 may be a chain, straps, swivel bearing, etc. One or more arms 272 are adjustably and/or reversibly mounted to the second punching bag 262. The second punching bag 262 may be connected to a bearing 264 and/or to the floor.

Figure 15:
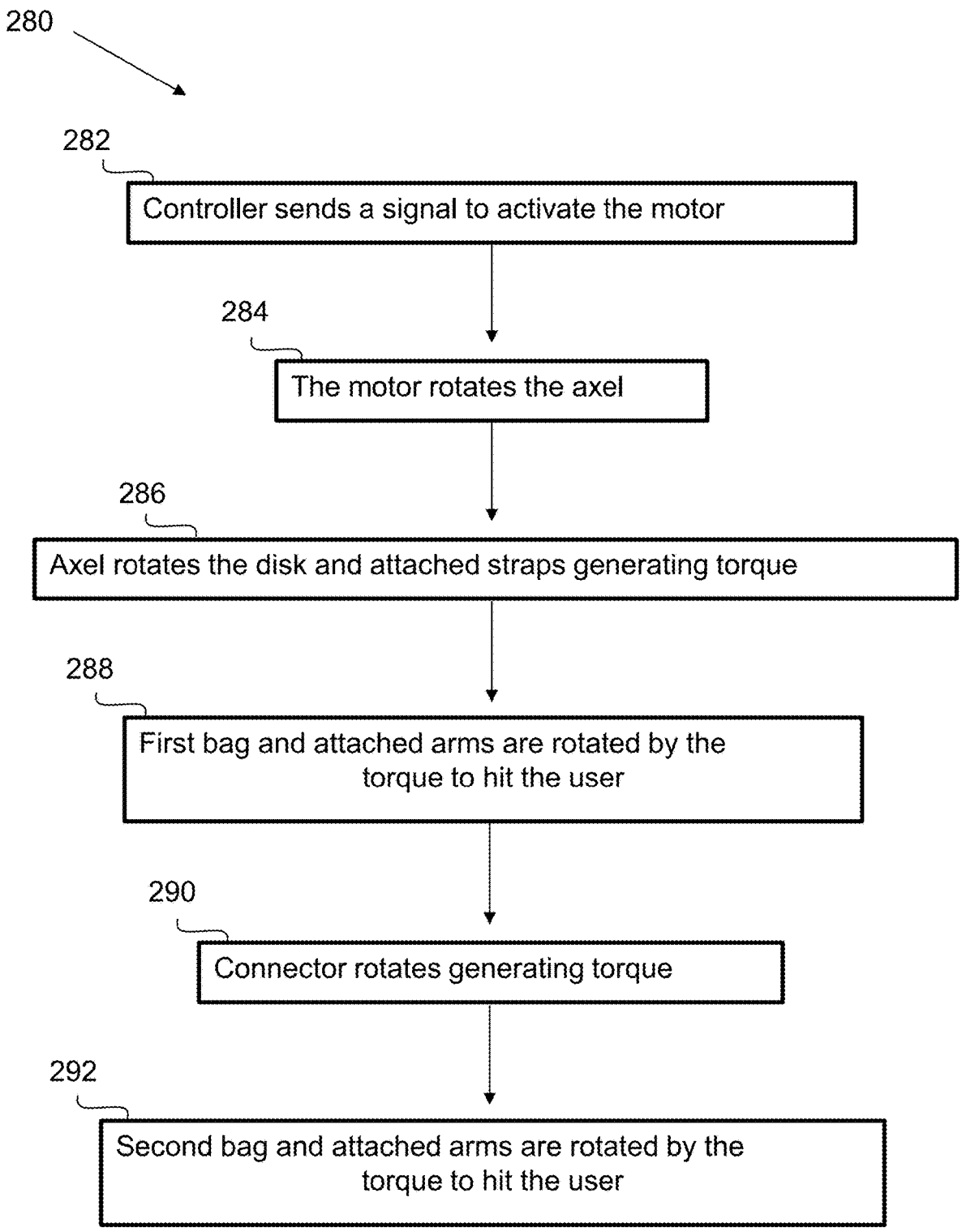
FIG. 15: Flow diagram of a punching bag in accordance with an embodiment of the current invention.

FIG. 15 is a flow diagram of a punching bag, in accordance with an embodiment of the current invention. For example, in method 280, a controller sends 282 a signal to activate a motor, the motor then rotates 284 an axel. The axel is be connected to a shock absorber, such as a disk and straps, which it rotates 286, rotational torque is generated by the axel twisting the straps and then allowing them to untwist, thereby rotating 288 a first punching bag and attached arms to hit 122 the user. The first punching bag may be connected to a second punching bag. The connector between the punching bags may twist and/or rotate generating torque 290 in response to rotation of the first punching bag, thereby causing the second punching bag to rotate 292 to hot the user.

Figure 16:
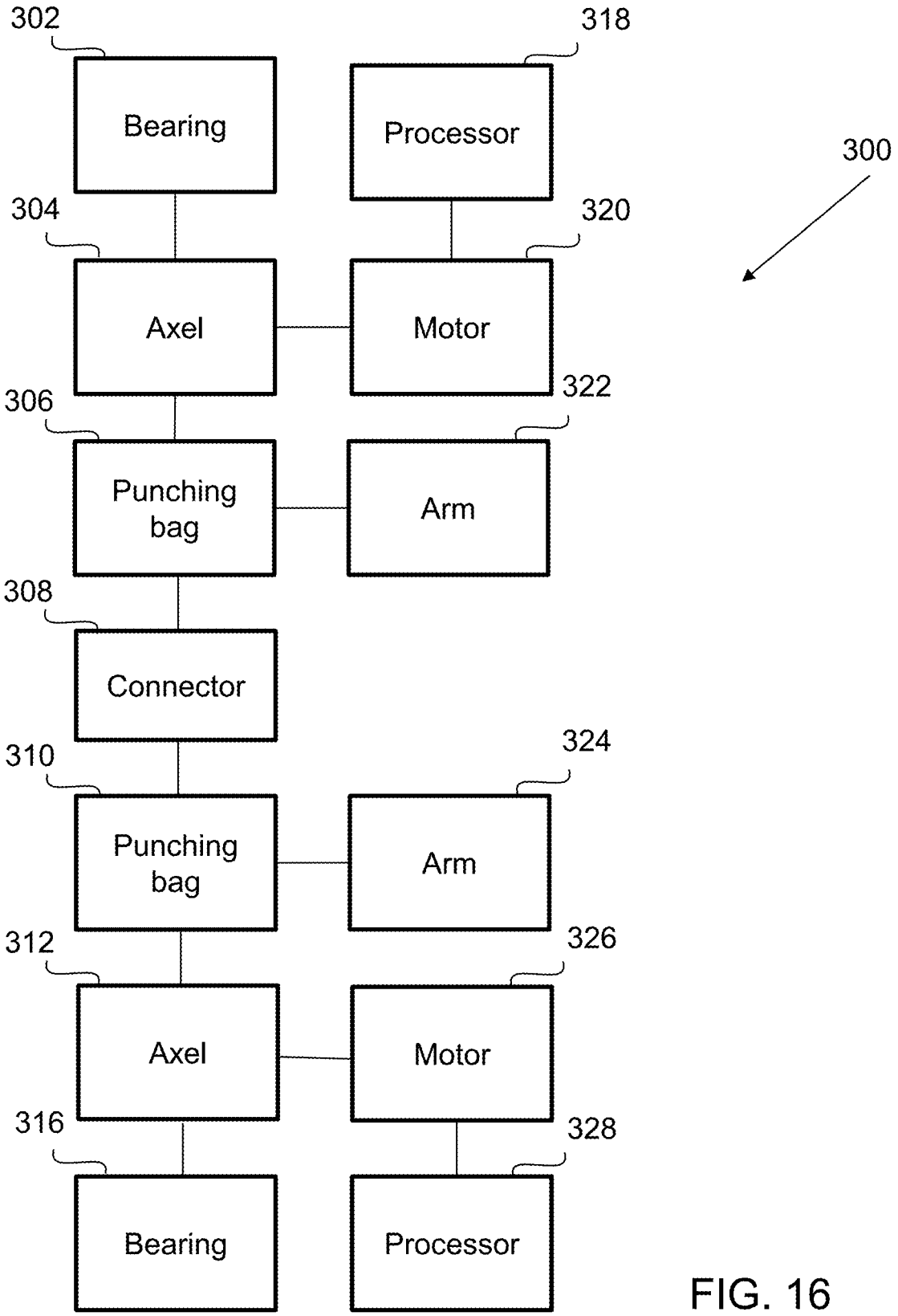
FIG. 16: Block diagram of a punching bag in accordance with an embodiment of the current invention.

FIG. 16 is a block diagram of a punching bag in accordance with an embodiment of the current invention. For example, the punch back punching bag 300 includes a bearing 302 connected to a support (e.g., a ceiling, floor, stand, bracket, etc.) to support the weight of the punch back punching bag 300. The bearing 302 may be connected to a rotatable axel 304, connected to a first motor 320. The first motor 320 supplies torque to the first punching bag and is preferably not weight bearing. The first motor 320 is connected to a processor 318, which may be controlled directly, manually, programmable, pre-programmable and/or optionally, by a remote controlled. Optionally, the axel 304 may be attached to one or more shock absorbers, e.g., straps and/or a disk which may absorb shock (rotation and/or translation) from a blow. The axel 304 and/or shock absorbers may be connected to a first punching bag 306, optionally through a disk and cone or more clips. One or more arms 322 are adjustably and/or reversibly mounted to the first punching bag 306. The first punching bag 306 may be connected by a connector 308 to a second punching bag 310 or to a bearing and/or to the floor. The connector 308 may be a chain, straps, swivel bearing, etc. One or more arms 324 are adjustably and/or reversibly mounted to the second punching bag 310. The second punching bag 310 may be connected to a bearing 316, a rotatable axel 312, and/or to the floor. Optionally, a rotatable axel 312, connected to a second motor 326. The second motor 326 supplies torque to the second punching bag and is preferably not weight bearing. The second motor 326 is connected to a processor 328, which may be controlled directly, manually, programmable, pre-programmable and/or optionally, by a remote controlled. Optionally, the axel 312 may be attached to one or more shock absorbers, e.g., straps and/or a disk which may absorb shock (rotation and/or translation) from a blow. Optionally, the axel 312 may be connected to a bearing 316 and/or the floor. Optionally, the first and second motors may function independently. Optionally, the first and second motors may be controlled independently. Optionally, the first and second motors may function in concert, e.g., sequentially and/or simultaneously. Optionally, the first and second motors may be controlled by a user interface.

Figure 17:
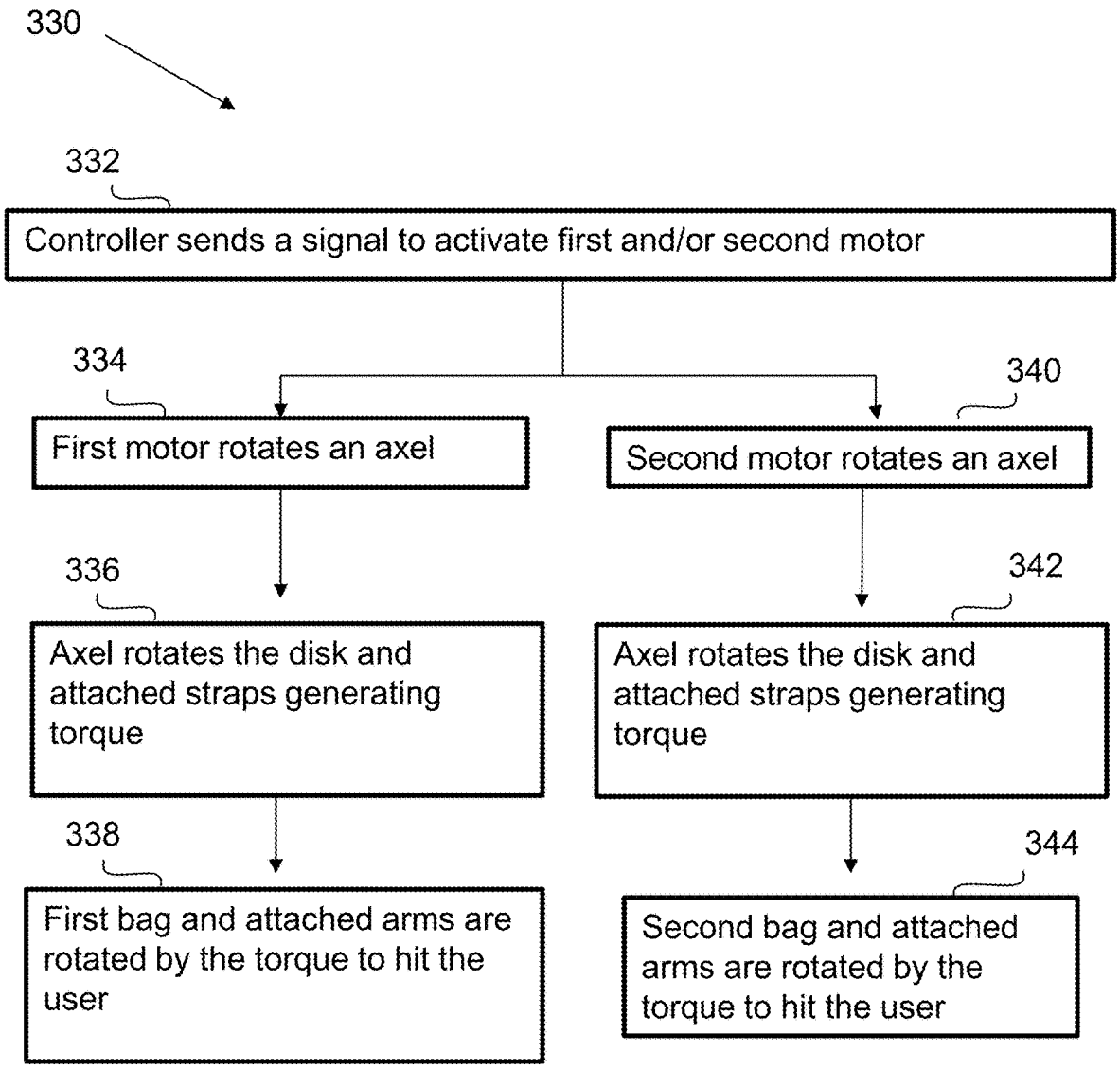
FIG. 17: Flow diagram of a punching bag in accordance with an embodiment of the current invention.

FIG. 17 is a flow diagram of a punching bag in accordance with an embodiment of the current invention. For example, in method 330, a controller sends 332 a signal to activate a first and a second motor. The first motor rotates 334 an axel. The axel is be connected to a shock absorber, such as a disk and straps, which it rotates, rotational torque is generated 336 by the axel twisting the straps and then allowing them to untwist, thereby rotating 338 a first punching bag and attached arms to hit the user. The second motor rotates 340 an axel. The axel is be connected to a shock absorber, such as a disk and straps, which it rotates, rotational torque is generated 342 by the axel twisting the straps and then allowing them to untwist, thereby rotating 344 a first punching bag and attached arms to hit the user. Optionally, the first and second motors may function independently. Optionally, the first and second motors may be controlled independently. Optionally, the first and second motors may function in concert, e.g., sequentially and/or simultaneously. Optionally, the first and second motors may be controlled by a user interface.

Figure 18:
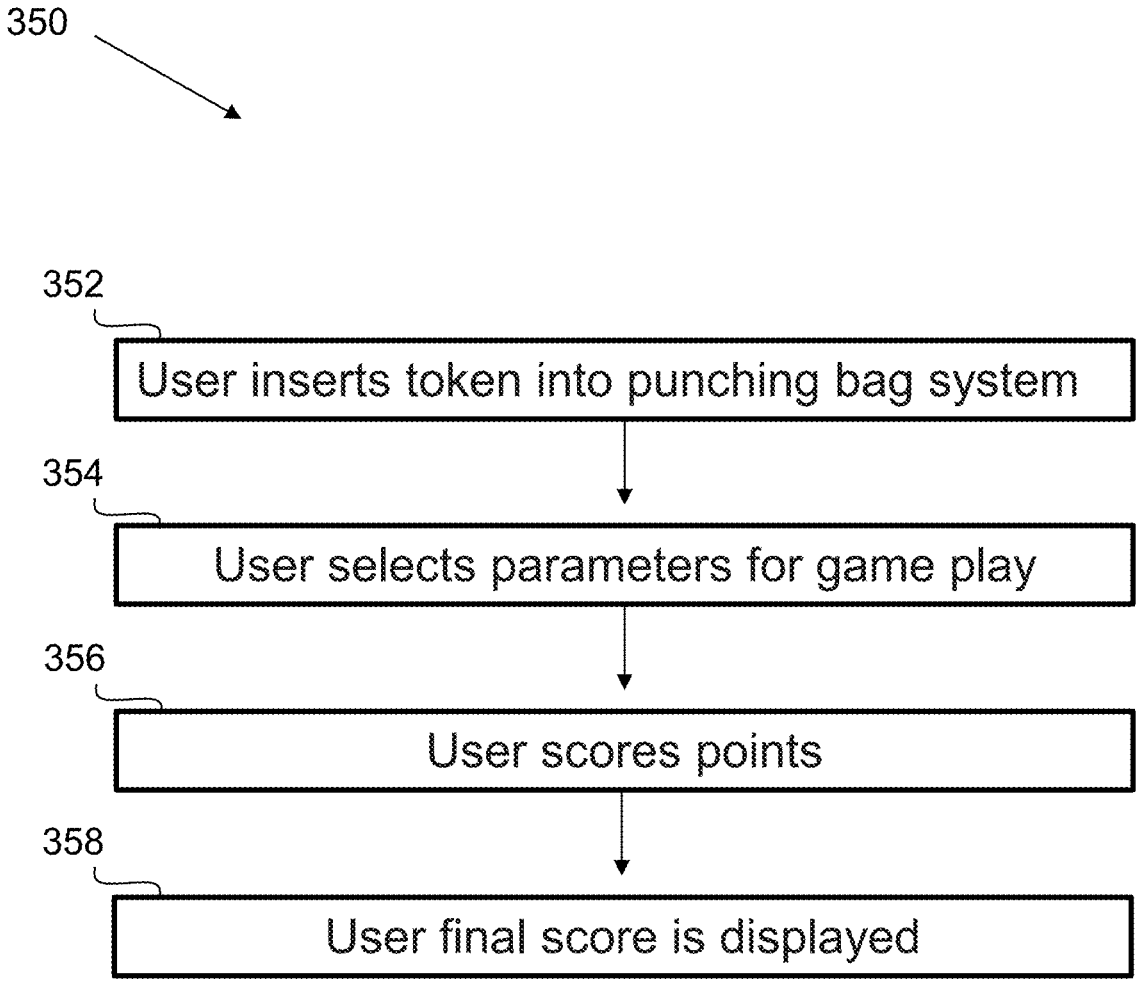
FIG. 18: A flow diagram of a punching bag game in accordance with an embodiment of the current invention.

FIG. 18 is a flow diagram of a punching bag game in accordance with an embodiment of the current invention. For example, in method 350, a user inserts 352 a token into the punching bag game system. User selects 354 one or more game parameters, e.g., style, speed, level, strength, height, weight, age, etc. User scores 356 points by hitting one or more markers, by blocking and/or avoiding blows from one or more arms, by the speed, strength and accuracy of their blows, etc. Feedback is provided to the user 358, e.g., the users final score is displayed at the end of the game.

In some embodiments, the punch back punching bag may be connected to a processor. Optionally, the processor may include various levels which a user may advance through, e.g., increasing in speed, and/or complexity, and/or strength, etc. Optionally, the processor may store the highest score/s for each level and/or overall game, e.g., the top 10 scores.

Optionally, these scores may be replaced if a higher score is achieved. Optionally, the game may be connected to one or more additionally punch back punching bags. Optionally, the additional punch back punching bags may be located in the same physical location (e.g., side by side, etc.) and/or in different physical locations (e.g., in different parts of a city, country, different countries, etc.). Optionally, the game may be played as a competition between two or more individuals sequentially and/or simultaneously. Optionally, the winner of the game may receive a prize. Optionally, the game may be observed physically and/or remotely. Optionally, the game may be recorded and/or replayed.

Figure 19:
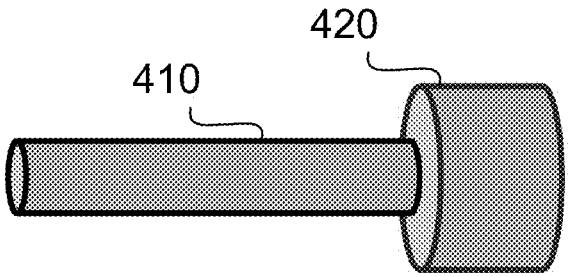
FIG. 19: A schematic illustration of an arm having a distal knob in accordance with an embodiment of the current invention.

FIG. 19 is a schematic illustration of an arm 410 having a distal knob 420 in accordance with an embodiment of the current invention. Optionally, arm 410 adjacent to the knob 420 is thinner that the knob 420.

Figure 20:
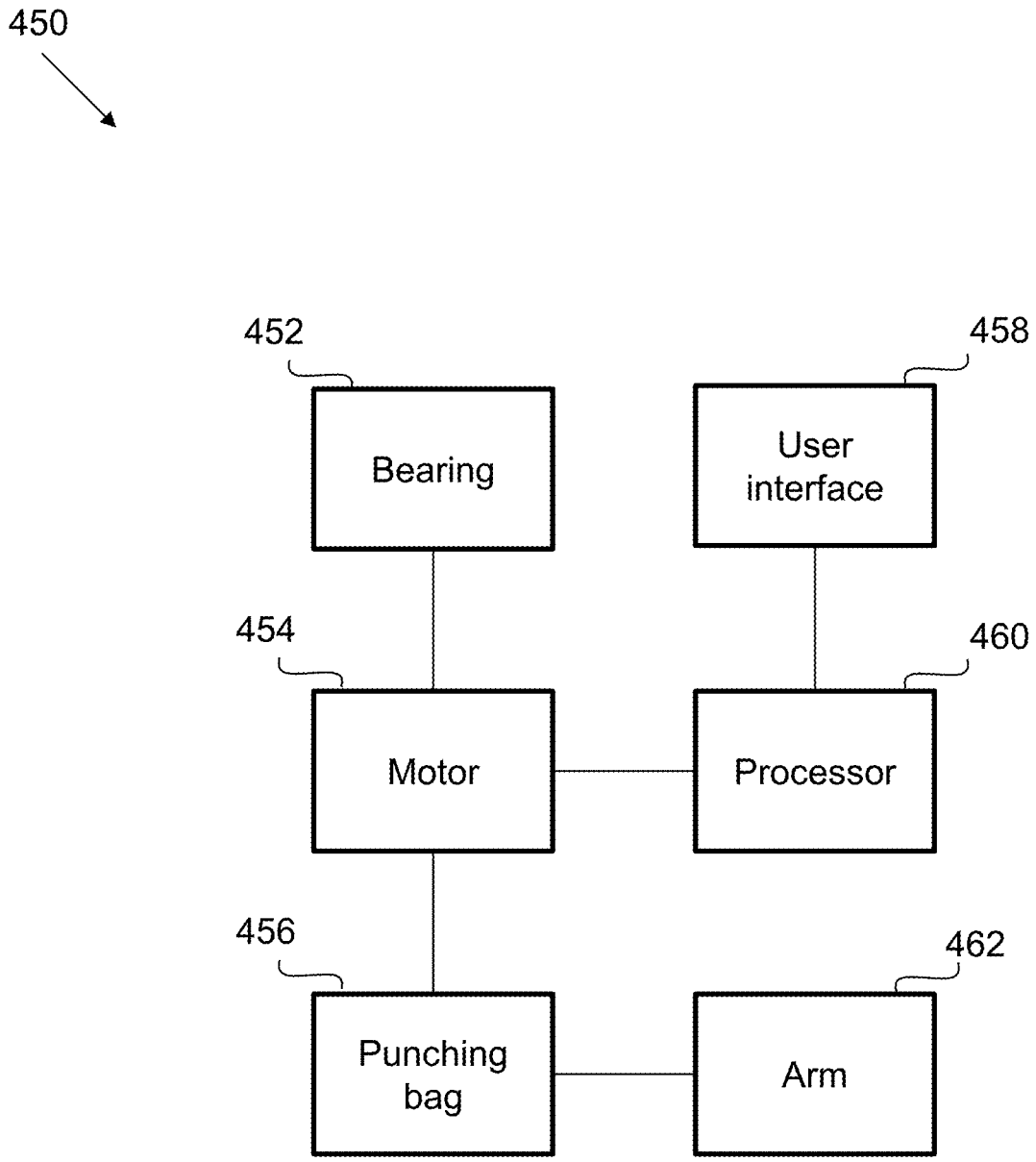
FIG. 20: A block diagram of a sparring game with a punch back punching bag in accordance with some embodiments.

FIG. 20: A block diagram of a sparring game with a punch back punching bag in accordance with some embodiments. For example, sparring game 450 may include a bearing 452 connected to rotatably support at least part of the weight of the punching bag 456, an arm 462 mounted on and protruding from a side of punching bag 456, a motor 454 configured for rotating punching bag 456 about bearing 452, wherein motor 454 is connected to a processor 460 and a user interface 458 configured to control the processor 460 and to facilitate selection of at least one user defined parameter.

According to some embodiments, processor 460 is programmable for a preset set of actions. Optionally, at least one user defined parameter is a fighting style, level, speed, power, weight, age, height, or any combination thereof.

According to some embodiments, the punch back punching bag may include two punching bags connected by a twistable connector (e.g., a chain, a strap, or a swivel bearing). Optionally, a first punching bag is suspended from the bearing and the second punching bag is connected to a second bearing from below. Optionally, the second punching bag is connected to a second bearing. Optionally, the second bearing is connected to or supported on a floor. Optionally, the second punching bag rotates independently of the first punching bag. Optionally, the second punching bag is attached to a second motor that drives rotation of said second bag. Optionally, the second punching bag includes a second arm protruding from a side thereof.

According to some embodiments, the first punching bag and/or the second punching bag include one or more target markers (e.g., one or more LED lights). According to some embodiments, the first punching bag and/or the second punching bag comprises one or more sensors. Optionally, the one or more target markers comprises one or more sensors configured to detect a blow. Optionally, the sensors are configured to detect a blow, position of a blow, strength of the blow, angle of the blow, speed of the blow or any combination thereof.

According to some embodiments, the user interface 458 is configured to provide audio and/or visual feedback to the user.

Figure 21:
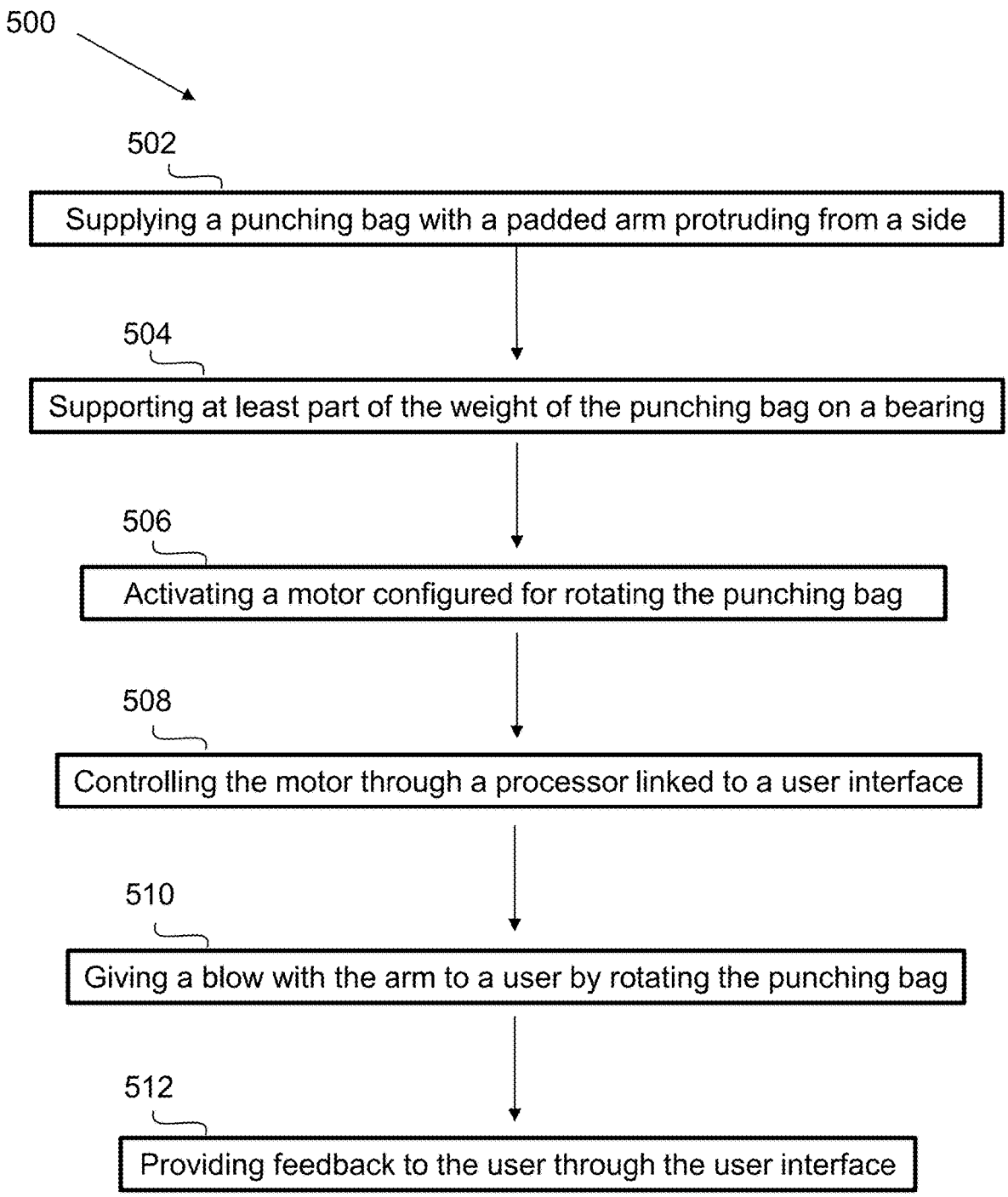
FIG. 21: A flow diagram of a sparring game with a punch back punching bag in accordance with an embodiment of the current invention.

FIG. 21 is a flow diagram of a method for a sparring game with a punch back punching bag in accordance with an embodiment of the current invention. For example, in method 500, the sparring game includes supplying 502 a punching bag with a padded arm protruding from a side thereof, supporting 504 at least part of the weight of the punching bag on a bearing, activating 506 a motor configured for rotating the punching bag, controlling 508 the motor through a processor linked to a user interface, wherein the user interface is configured to control the processor and to facilitate selection of at least one user defined parameter, giving 510 a blow with said arm to a sparring user as a result of said rotating; and providing 512 audio and/or visual feedback to the user by the user interface.

According to some embodiments, the at least one user defined parameter is selected through the user interface, wherein the at least one user defined parameter is a fighting style, level, speed, weight, age, height, or any combination thereof. Optionally, programing the processor for a preset set of actions. Optionally, detecting a blow to the punching bag by one or more sensors, e.g., the position of a blow, strength of the blow, angle of the blow, speed of the blow, or any combination thereof.

These embodiments are provided by way of example and are in no means intended to be limiting the scope of the invention.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

General

It is expected that during the life of a patent maturing from this application many relevant building technologies, artificial intelligence methodologies, computer user interfaces, image capture devices will be developed and the scope of the terms for design elements, analysis routines, user devices is intended to include all such new technologies a priori.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

As will be appreciated by one skilled in the art, some embodiments of the present invention may be embodied as a system, method or computer program product. Accordingly, some embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, some embodiments of the present invention may take the form of a computer program product embodied in one or more computer readable medium(s) having computer readable program code embodied thereon. Implementation of the method and/or system of some embodiments of the invention can involve performing and/or completing selected tasks manually, automatically, or a combination thereof. Moreover, according to actual instrumentation and equipment of some embodiments of the method and/or system of the invention, several selected tasks could be implemented by hardware, by software or by firmware and/or by a combination thereof, e.g., using an operating system.

For example, hardware for performing selected tasks according to some embodiments of the invention could be implemented as a chip or a circuit. As software, selected tasks according to some embodiments of the invention could be implemented as a plurality of software instructions being executed by a computer using any suitable operating system.

In an exemplary embodiment of the invention, one or more tasks according to some exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

Any combination of one or more computer readable medium(s) may be utilized for some embodiments of the invention. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium and/or data used thereby may be transmitted using any appropriate medium, including but not limited to wireless, wireline, optical fiber cable, RF, etc., or any suitable combination of the foregoing.

Computer program code for carrying out operations for some embodiments of the present invention may be written in any combination of one or more programming languages, including an object-oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Some embodiments of the present invention may be described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Data and/or program code may be accessed and/or shared over a network, for example the Internet. For example, data may be shared and/or accessed using a social network. A processor may include remote processing capabilities for example available over a network (e.g., the Internet). For example, resources may be accessed via cloud computing. The term "cloud computing" refers to the use of computational resources that are available remotely over a public network, such as the internet, and that may be provided for example at a low cost and/or on an hourly basis. Any virtual or physical computer that is in electronic communication with such a public network could potentially be available as a computational resource. To provide computational resources via the cloud network on a secure basis, computers that access the cloud network may employ standard security encryption protocols such as SSL and PGP, which are well known in the industry.

Some of the methods described herein are generally designed only for use by a computer, and may not be feasible or practical for performing purely manually, by a human expert. A human expert who wanted to manually perform similar tasks might be expected to use completely different methods, e.g., making use of expert knowledge and/or the pattern recognition capabilities of the human brain, which would be vastly more efficient than manually going through the steps of the methods described herein.

As used herein the term "about" refers to ± 10%

The terms "comprises", "comprising", "includes", "including", "having" and their conjugates mean "including but not limited to."

The term "consisting of" means "including and limited to."

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may be provided in combination in a single embodiment. Conversely, various features of the invention, which are, for brevity, described in the context of a single embodiment, may be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A system for sparring with a first punching bag comprising:

a bearing suspended from a support connected to rotatably support at least part of a weight of the first punching bag;

a motor configured for rotating the first punching bag;

a shock absorber interconnecting between the first punching bag and the motor, wherein the shock absorber is configured to absorb rotational and translational shock from a blow; and a rigid static arm mounted on and protruding from a side of the first punching bag, wherein the arm is padded.

2. The system of claim 1, wherein the first punching bag is connected to a second punching bag including a second arm protruding from a side thereof.

3. The system of claim 2, wherein said second punching bag rotates independently of said first punching bag.

4. The system of claim 3, wherein the second punching bag is attached to a second motor that drives rotation of said second bag.

5. The system of claim 1, wherein the first punching bag is connected to the bearing by a tension element.

6. The system of claim 1, wherein the motor is not weight bearing.

7. The system of claim 1, wherein the motor is connected to a processor controlled by a user interface.

8. The system of claim 1, wherein the motor is connected to a processor programable for a preset set of actions.

9. The system of claim 1, wherein the arm is reversibly mounted on the first punching bag.

10. The system of claim 1, wherein at the first punching bag comprises a target marker.

11. The system of claim 1, wherein the first punching bag comprises a sensor to detect a blow.

12. The system of claim 1, wherein the shock absorber includes straps and a disk.

13. A method for sparring with a punch back punching bag, the method comprising:

supplying a first punching bag with a rigid static padded arm protruding from a side thereof;

supporting at least part of a weight of the first punching bag on a bearing suspended from a support;

rotating the first punching bag with a motor wherein the motor does not support the entire weight of the first punching bag;

giving a blow with said padded arm to a sparring user as a result of said rotating; and absorbing the shock of said blow with a shock absorber interconnecting between the first punching bag and the motor, wherein the shock absorber is configured for absorbing rotational and translational shock from a blow.

14. The method of claim 13, further comprising absorbing shock between the first punching bag and the motor with a shock absorber.

* * * * *